US011865431B1

(12) United States Patent
Baker

(10) Patent No.: US 11,865,431 B1
(45) Date of Patent: Jan. 9, 2024

(54) GLOVE

(71) Applicant: Scott Bradley Baker, Sherman Oaks, CA (US)

(72) Inventor: Scott Bradley Baker, Sherman Oaks, CA (US)

( * ) Notice: Subject to any disclaimer, the term of this patent is extended or adjusted under 35 U.S.C. 154(b) by 539 days.

(21) Appl. No.: 15/853,255

(22) Filed: Dec. 22, 2017

Related U.S. Application Data

(63) Continuation-in-part of application No. 15/794,890, filed on Oct. 26, 2017, now abandoned.

(60) Provisional application No. 62/413,550, filed on Oct. 27, 2016, provisional application No. 62/421,223, filed on Nov. 12, 2016.

(51) Int. Cl.
*A63B 71/14* (2006.01)
*A41D 19/015* (2006.01)

(52) U.S. Cl.
CPC ..... *A63B 71/145* (2013.01); *A41D 19/01582* (2013.01); *A63B 2244/102* (2013.01)

(58) Field of Classification Search
CPC ..... A63B 71/145; A63B 2244/102; A41D 19/01582
USPC ..... 2/18
See application file for complete search history.

(56) References Cited

U.S. PATENT DOCUMENTS

| | | | | |
|---|---|---|---|---|
| 4,345,335 | A * | 8/1982 | Shih-Li | A63B 31/04 2/161.1 |
| 4,494,249 | A * | 1/1985 | Hansson | A41D 19/01588 2/161.6 |
| 6,691,315 | B1 * | 2/2004 | Clarke | A41D 19/01523 2/18 |
| 7,234,172 | B1 * | 6/2007 | Hoelscher | A41D 19/01582 2/161.1 |
| 7,415,735 | B2 * | 8/2008 | Erickson | A41D 19/01547 2/163 |
| 2008/0000010 | A1 * | 1/2008 | Erickson | A41D 19/01582 2/161.6 |

* cited by examiner

*Primary Examiner* — Clinton T Ostrup
*Assistant Examiner* — Catherine M Ferreira

(57) ABSTRACT

A glove comprises an upper surface, a lower surface, finger sheaths, a thumb sheath, and movement control members associated with the finger sheaths to prevent the finger sheaths from moving into a linear extended position, while allowing the finger sheaths to be in a curved position or a clenched position.

21 Claims, 28 Drawing Sheets

GLOVE

CROSS-REFERENCE TO RELATED APPLICATIONS

This application is a continuation-in-part application of U.S. patent application Ser. No. 15/794,890 filed Oct. 26, 2017, which claims the benefit of U.S. Provisional Patent Application No. 62/413,550 filed Oct. 27, 2016 and U.S. Provisional Patent Application No. 62/421,223 filed Nov. 11, 2016, the contents of all of which are incorporated herein by reference in their entirety.

FIELD AND BACKGROUND OF THE INVENTION

This invention relates to a glove. More particularly, the invention is for a glove which may be used by an athlete, and wherein the glove is constructed so that hand movement within the glove is somewhat limited or restricted. In one form, the glove may be used by a person practicing in the fields of boxing or mixed martial arts (MMA), although the invention is not limited thereto.

Fighting has long been a popular sport. For most of the last 100 years or so boxing has been a dominant force in attracting viewers and thus revenue. As the sport has evolved with stronger athletes, athlete protection has become more and more advanced. The boxing glove of 50 years ago is more like a mitten when compared to the boxing gloves available today. Not only has the outside of the glove changed, but the inside mechanics have also evolved to better protect the fighter's hands.

Over about the last 20 years and certainly in the last 10 years, Mixed Martial Arts (MMA) has become one of the top fighting sports in attracting viewers and revenues from boxing. While the rules have developed significantly as with anything new, the protection for the fighters has been lagging behind in one particular arena.

The very nature of "mixed" martial arts involves a mix comprising predominantly boxing techniques and grappling techniques. Grappling techniques require that a fighter's hands, specifically his fingers, be free from the type of confinement a boxing glove incorporates, such that the fighter's fingers are exposed thereby allowing fighters to use the dexterity and mobility of their fingers in order to grab an opponent in a variety of ways in an effort to submit him and win the contest.

One of the safety issues that has long existed in MMA specifically as a result of the "open fingered glove" designs is "eye pokes". An eye poke can occur at any time and with no malicious intent attached to it. When a fighter is moving closer and perhaps starts to throw a punch (with a clenched fist), but suddenly has to adapt to a movement from the opponent by changing that clenched fist into an open palmed block of some sort, the fingertip on an extended or straightened hand can drive directly into the opponent's eye causing at the very minimum discomfort and momentary blurred vision, but also potentially permanent eye damage.

In combat sports, and more specifically mixed martial arts, boxing is mixed with wrestling (grappling). The boxing function requires a clenched fist posture, while the grappling requires a hand to be open and extendable. Therefore, the respective design of gloves worn by such fighters is different, with fingers exposed and free to grab and move in the case of mixed martial arts, and the hands completely encapsulated for a boxing glove. In mixed martial arts, where both boxing and grappling is used, conventional gloves with fingers exposed and free to move may increase the risk of injury, even though unintentional.

There has long been a need for a glove design that offers padding similar to a boxing glove while allowing finger movement to grab, and at the same time restricting the ability for a finger to poke an opponent's eyeball, or other vulnerable body part.

SUMMARY OF THE INVENTION

In one aspect of the invention, there is provided a glove preferably for use in Mixed Martial Arts (MMA) for protecting a fighter's hands while allowing that fighter to use his fingers and also protecting the fighter's opponents from an accidental fingertip eye poke or other injury.

A glove in accordance with the present invention limits the uses hand to positions: the clenched fist position, and the "at rest" position, in which the hand cannot achieve a fully extended position.

Current MMA gloves are produced in a few sizes which by that very nature do not afford a tight fit surrounding the fingers themselves. In fact, many glove designs have a pliable material utilized for the sides of the fingers while the top and bottom portions of the gloves are typically a stronger material such as leather. MMA gloves allow for the thumb to be fully or partially exposed and the fingers to have one or two knuckles per finger exposed. The pliable material on the sides of gloves allows for even more movement of the finger inside the actual finger area of the glove.

The built-in mobility combined with the added movement due to the material choice in a conventional glove allows for a fighter's fingers to be straightened out completely and risk the occurrence of an eye poke to an opponent.

The current invention is directed toward resolving this safety issue while offering a better fit and better flexibility for the fighter.

When a person's hands are in a naturally relaxed state, there is a curve to the hand. The palm is cupped and the fingers are arched. This is the position to which the present invention restricts the user's hand in relation to the ability to further open or straighten the hand. Conversely, the glove of the invention does not restrict the user's hands from closing completely and unimpeded. Further, it should be noted that the materials used in the current invention are of a type that offers an expandable characteristic that allows for a more secure hand fitting while restricting additional free movement as found in current designs now available.

By restricting the user's ability to extend and straighten the fingers, the potential for an unintended eye poke, or other injury which may be caused to an opponent by an extended finger, is quite notably limited as the natural arch of the hand and fingers is not programmed or specifically adapted for making contact in any manner or fashion. An open hand and straight fingers are more commonplace for slapping, as a clenched fist is for punching. With the open hand position no longer an option due to the movement limitations imposed by the glove of the invention, a user throwing his hand randomly at their opponent and causing eye damage will stop occurring or be significantly diminished.

Additionally, the design of the present invention also utilizes connective materials to limit the amount of independent movement between individual fingers. This design feature will limit the potential for finger joint injuries in users.

DETAILED DESCRIPTION OF THE INVENTION

The invention will now be described in further detail with reference to the accompanying drawings. The various drawings in this application show different embodiments of a glove in accordance with the invention, all of which possess the ability to configure the hands, and restrict certain movements thereof, by an athlete especially one engaged in the sport of mixed martial arts (MMA). An important objective of the invention is to provide a glove which limits or restricts the use of hand movement to prevent the fingers extending in a generally linear manner, and attempts to keep the fingers in a curved or arcuate condition in order to protect an opponent from certain injuries, such as an eye poke. The glove of the invention will also allow the user to adopt a clenched fist position.

Figure 1:
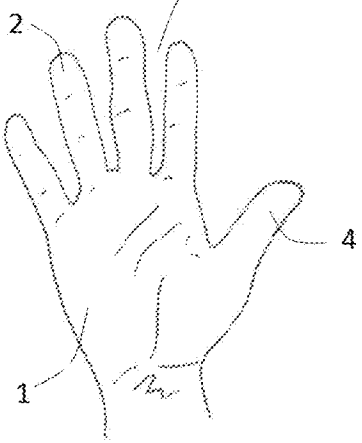
FIGS. 1, 2, 3, 4 and 5 are illustrations of the human hand in different positions.
Figure 2:
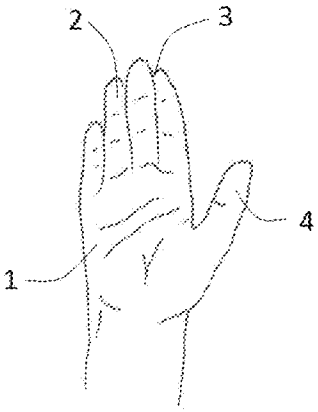
Figure 3:
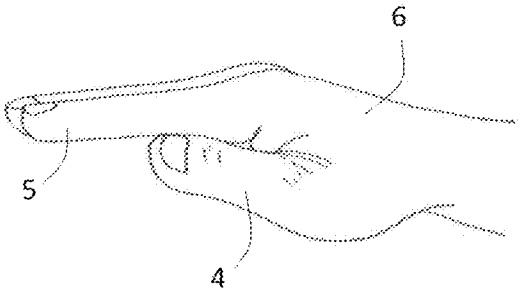
Figure 4:
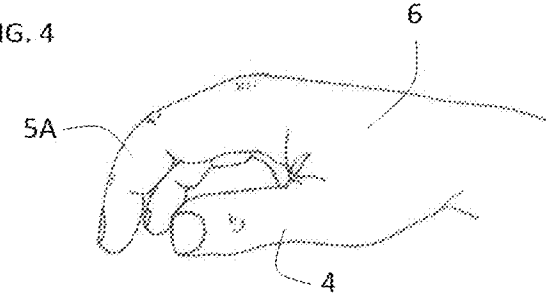
Figure 5:
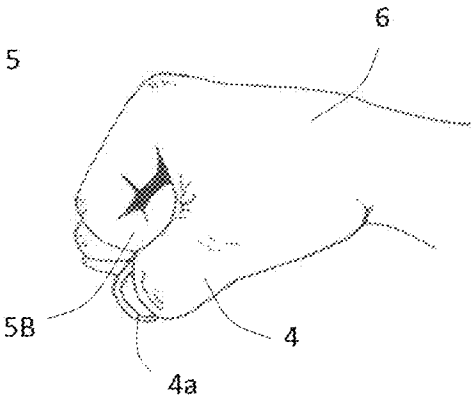

FIGS. 1, 2, 3, 4 and 5 are introductory figures showing different views and positions of the human hand. FIG. 1 shows a hand in a flat extended, straightened and expanded position with the palm up, FIG. 2 shows a basic hand in a flat extended position, FIG. 3 shows the hand in a flat extended position from a side view, FIG. 4 shows a hand in a natural state position from a side view, and FIG. 5 shows a hand in a clenched position from a side view. A hand 1 is shown in the extended position with the palm up, with fingers 2 extended. A gap 3 is shown between the fingers and FIGS. 1 and 2 show an extended thumb 4. In FIG. 3, the fingers 2 are in the extended position 5, shown in a side view, with the back of the hand extended. In FIG. 4, the fingers 2 are in the natural slightly curved position 5A with the back of the hand 6 in a relaxed position. In FIG. 5, the fingers 2 are shown in a clenched or fisted position 5B, wherein the thumb tip 4A of the thumb 4 is bent across the fingers 2. This FIG. 5 also shows the back of the hand in a clenched position.

Figure 6:
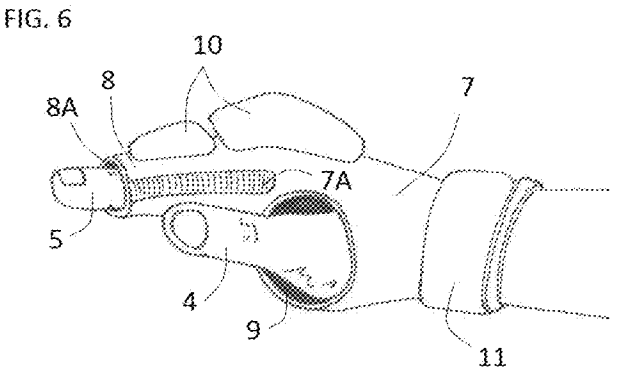
FIGS. 6, 7 and 8 show a mixed martial arts (MMA) glove of the prior art.
Figure 7:
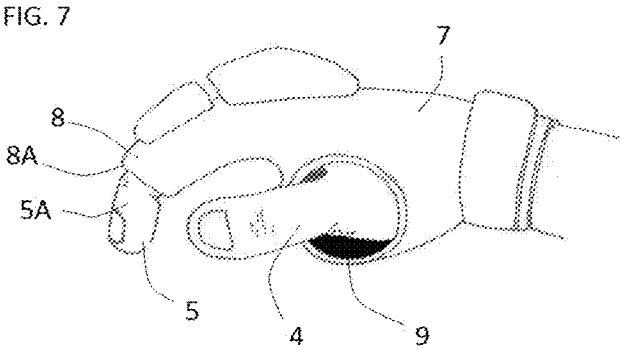
Figure 8:
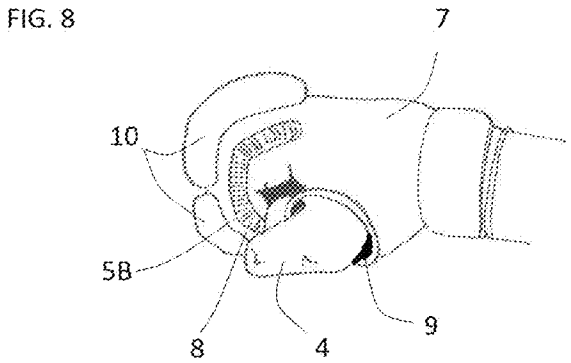

FIGS. 6, 7 and 8 show a conventional mixed martial arts (MMA) glove in three different positions, namely, extended flat, natural, and clenched. There is no thumb sheath, just an oversized hole for the thumb. The knuckle padding and fastening strap are consistent, and this glove allows for the fingers to straighten when in use, during a fight, with the potential for injury, such as an eye poke. The oversized sheaths allow for finger movement inside the glove itself which may also potentially cause other injuries to the user and the opponent, such as when the opponent grabs the inside glove sheaths, thereby bending finger joints. Some MMA gloves have even shorter fingers sheaths than those illustrated in these figures.

In FIG. 6, there is shown a thumb 4 and finger in the extended position 5. The natural finger position 5A is illustrated in FIG. 7. The standard glove 7 is shown in FIG. 6 with the hand extended, in FIG. 7 with the hand in the natural position, and in FIG. 8 with the hand in the clenched position. The glove includes further fingers sheath 8, and oversized thumb opening 9, knuckle padding 10 and a fastening strap 11. It also shows an additional expensive material 7A for added internal hand movement. In FIG. 7, the fingers 5B are in the natural position 5A, while in FIG. 8, the fingers 5B are in the clenched position 5B.

Figure 9:
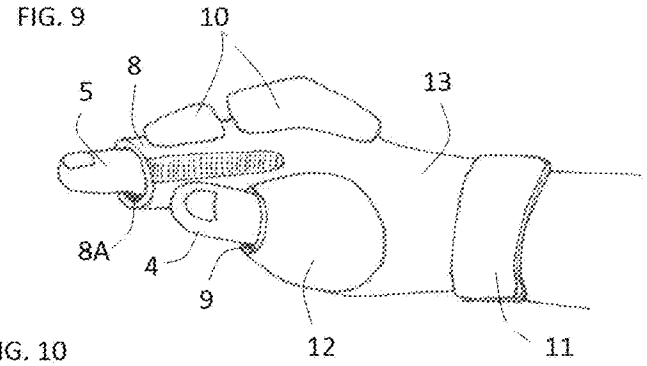
FIGS. 9, 10 and 11 show another version of a mixed martial arts glove of the prior art.
Figure 10:
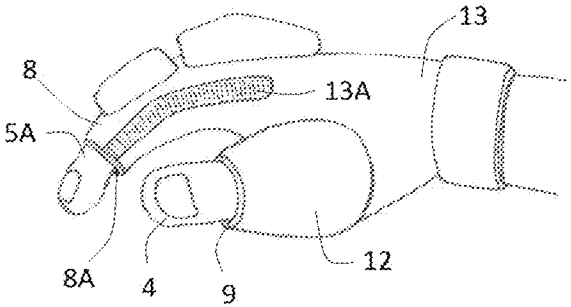
Figure 11:
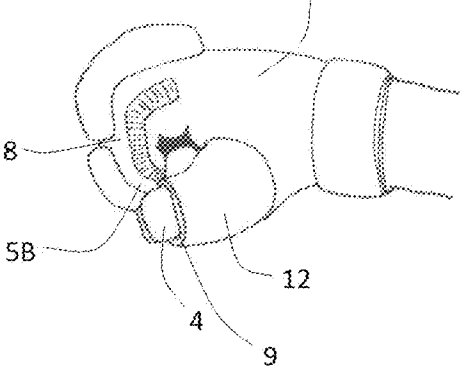

FIGS. 9, 10 and 11 show another version of a conventional glove. In these figures, corresponding reference numerals to those used in FIGS. 6, 7 and 8 are utilized. This standard MMA glove 13 further comprises a thumb sheath 12. FIG. 9 shows the hand in the extended position, FIG. 10 shows the hand in the natural curve position, while FIG. 11 shows the hand in the clenched position.

Figure 12:
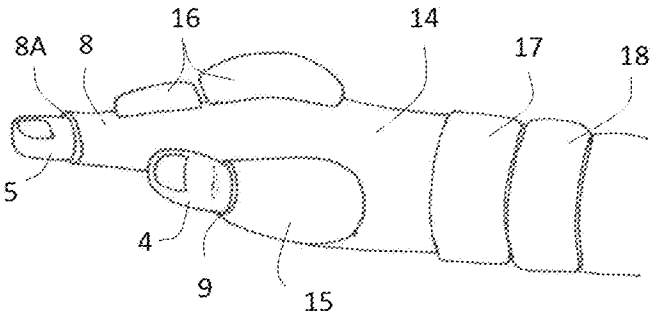
FIGS. 12, 13 and 14 illustrate a glove in accordance with a first embodiment of the present invention, each figure showing a hand that is in the glove in different positions.
Figure 13:
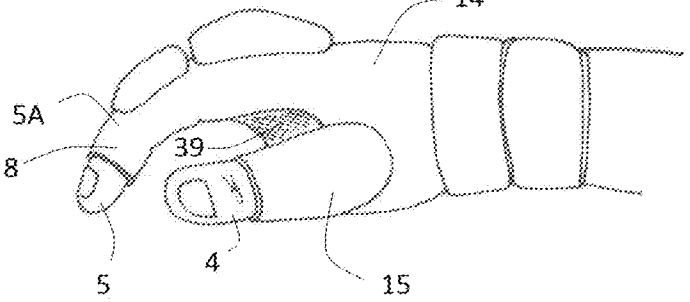
Figure 14:
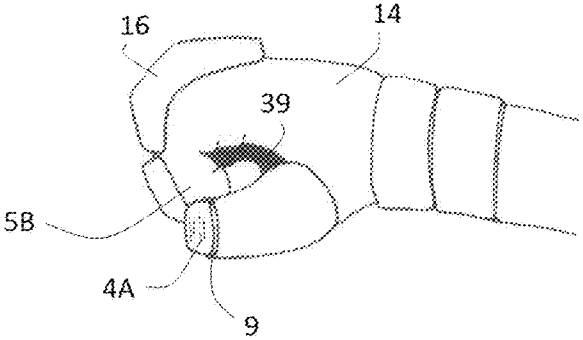

Referring now to FIGS. 12, 13 and 14, there is shown a first embodiment of a glove 14 in accordance with the present invention. FIG. 12 shows a hand in the extended position, FIG. 13 shows the hand in the natural position, and FIG. 14 shows a hand in the clenched position. The glove 14 includes a thumb sheath 15 and knuckle padding 16, as well as an upper fastening strap 17, and a lower fastening strap 18. As clearly seen in FIGS. 13 and 14, there is a thumb sheath to index finger sheath which comprises a webbing 39 to restrict movement. This restrictive movement webbing 39 has as one of its objectives the ability to keep the thumb and adjacent finger from separating beyond a certain amount of distance.

FIGS. 12, 13 and 14 show an embodiment of the glove of the invention shown in three positions and highlight the fact that the finger and thumb sheaths offer a skintight fit to limit or prevent hand movement separately and apart from the glove itself. FIG. 13 also shows the webbing 39 between the thumb sheath and finger sheath to restrict independent movement from each other from being outside the normal functional joint range, thus potentially limiting joint injuries when grabbed or twisted, or from an awkward strike position.

Figure 17:
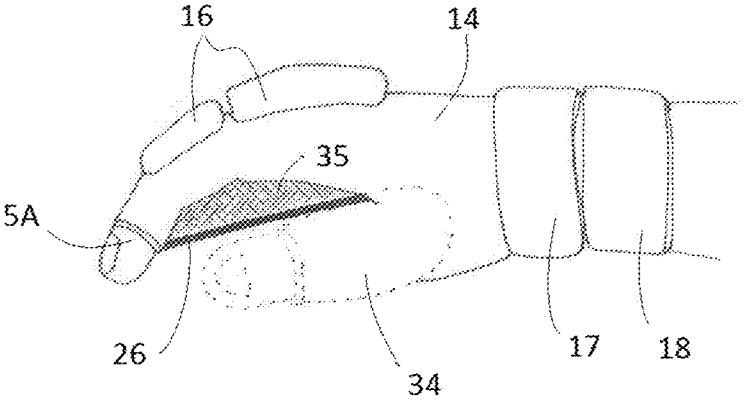
FIG. 17 shows a hand in a glove illustrated in FIG. 16 with the thumb sheath removed.
Figure 18:
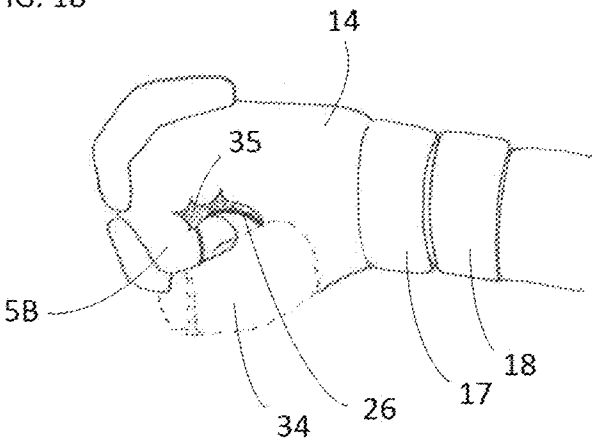
FIG. 18 shows a hand in the glove illustrated in FIG. 17 with the hand in the clenched position.
Figure 15:
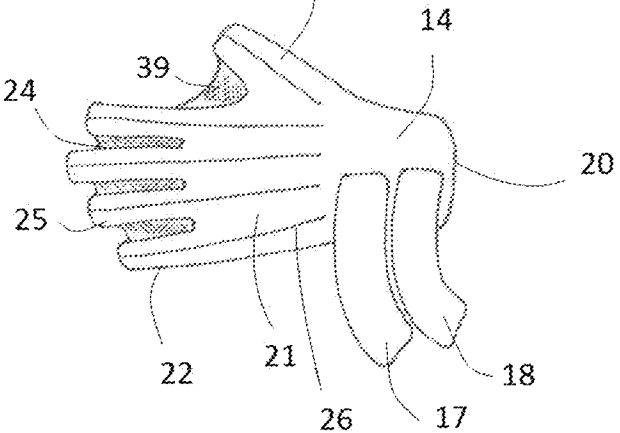
FIG. 15 shows a palm up view of a glove of the first embodiment.
Figure 16:
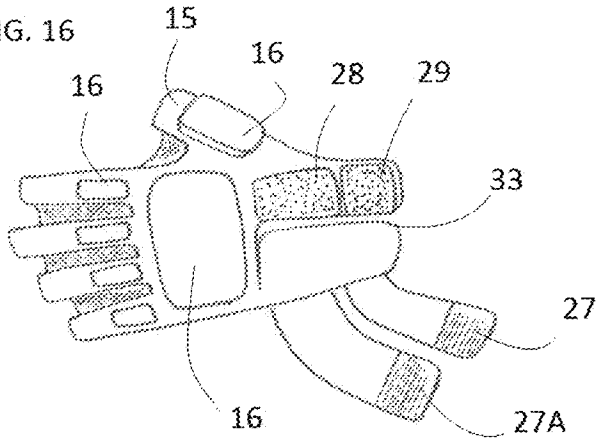
FIG. 16 shows a back side view of the glove shown in FIG. 15.

FIG. 15 shows the opening 20 through which the hand is inserted into the glove. A finger sheath 22 is provided and further finger sheath to finger sheath restrictive movement webbing 24 is provided to control the extent to which the fingers may be separated. A finger sheath 25 is provided and the glove incorporates restrictive cording 26 as shown in FIGS. 15, 17 and 18. A sheath 39 between thumb and finger also provides restrictive movement webbing. A lower fastening strap 18 which may hold a Velcro material 27 releasably attaches to the lower fastening strap contact adhesion material 29, and an upper fastening strap 17 which may hold a Velcro material 27A releasably attaches to the upper fastening strap contact adhesion material 28. An entry opening slot 33 is provided.

FIG. 17 also illustrates the restrictive cording 26 and the restrictive webbing 35, which help to keep the opponent's fingers from grabbing the cording. In FIGS. 17 and 18, the thumb sheath 34 has been omitted from the drawing for better viewing of the restrictive webbing 35.

Figure 19:
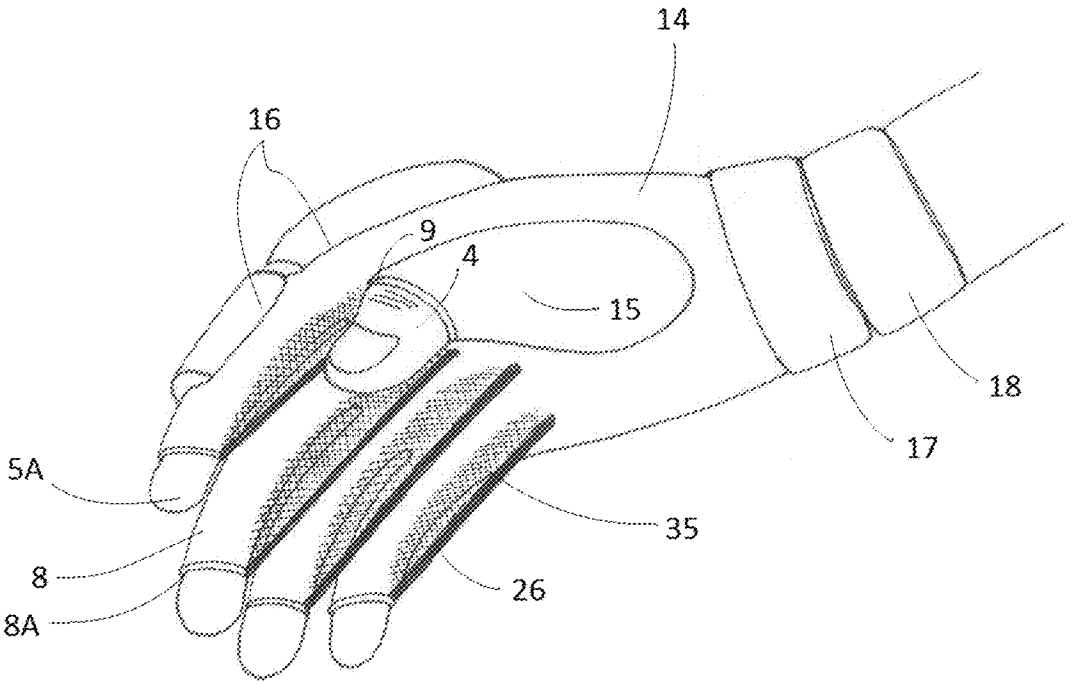
FIG. 19 shows a further perspective view of a glove illustrated in FIG. 12.

FIG. 19 shows a perspective view of the glove in this embodiment. The cording 26 is attached to the finger sheath on the bottom of the fingers at one end and attaches to the lower palm area at the other.

Figure 22:
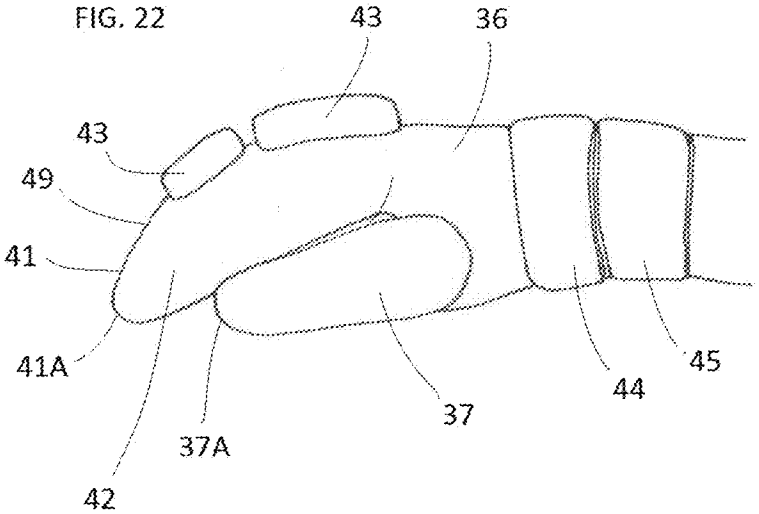
FIG. 22 shows a hand in a glove illustrated in FIG. 20 with the fingers in a relaxed position.
Figure 23:
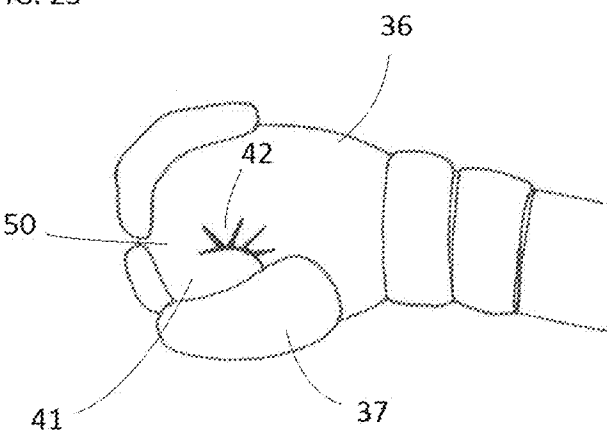
FIG. 23 shows a hand in a glove illustrated in FIG. 20, with the fingers in the clenched position.
Figure 20:
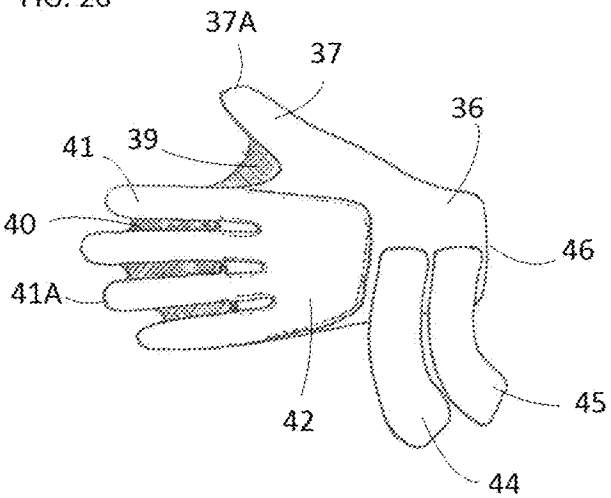
FIG. 20 shows a palm up view of a glove illustrating a second embodiment of the present invention.
Figure 21:
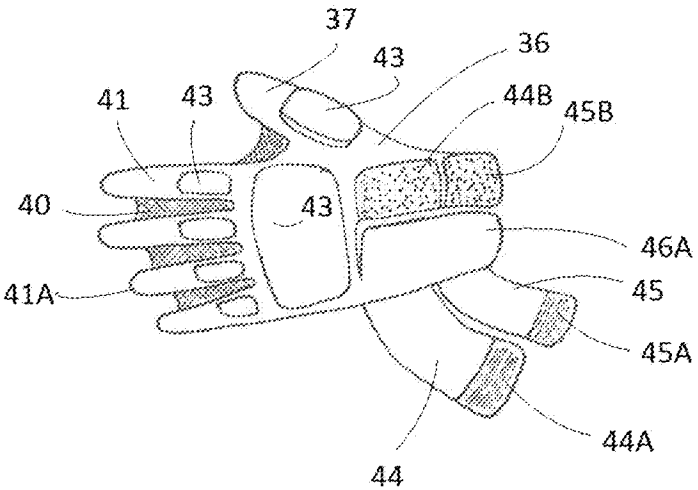
FIG. 21 is a palm down view of the glove shown in FIG. 20.

FIGS. 20 to 26 show a further embodiment of a glove 36 in accordance with the invention. FIG. 20 is a palm up view, FIG. 21 is a palm down view, FIG. 22 is a side view with the hand in the natural resting position, and FIG. 23 is a further side view with the hand in a clenched position.

There is provided a thumb sheath 37 with a thumb sheath tip 37A, constituting a closed end. Webbing 39 restricts movement from thumb sheath to finger sheath, while webbing 40 restricts movement from finger sheath 41 to finger sheath 41. The finger sheath 41 with a sheath tip 41A constituting closed ends. The glove 36 further comprises a restrictive outer surface material 42 on the palm side, an upper fastening strap 44, a lower fastening strap 45, and an opening 46 through which the hand is placed into the glove 36. Further, some of these views show the knuckle padding 43. Upper fastening securement material 44A attaches to securement material 44B, and securement material 45A attaches to securement material 45B. An opening 46A provides a hand additional entry flap. Further, there is an outer top material 49. In FIG. 22, there is shown the restrictive bottom outer surface material 42, while FIG. 23 of the drawings illustrates the restrictive side outer material 50.

The netting 39 and 40 may be mildly flexible, but still keeps the fingers limited in their ability to move away from each other, helping to keep injuries to a minimum, especially if grabbed by an opponent. Closed finger and thumb sheaths 37A and 41A are provided. The cover material 42 may be utilized to restrict the full extension of the fingers.

As shown in FIG. 22, the material 42 may restrict the length of the palm material, and wrapping it up the sides to the top material has the effect of restricting mobility, but only in the direction of extension, and not for clenching.

Figure 24:
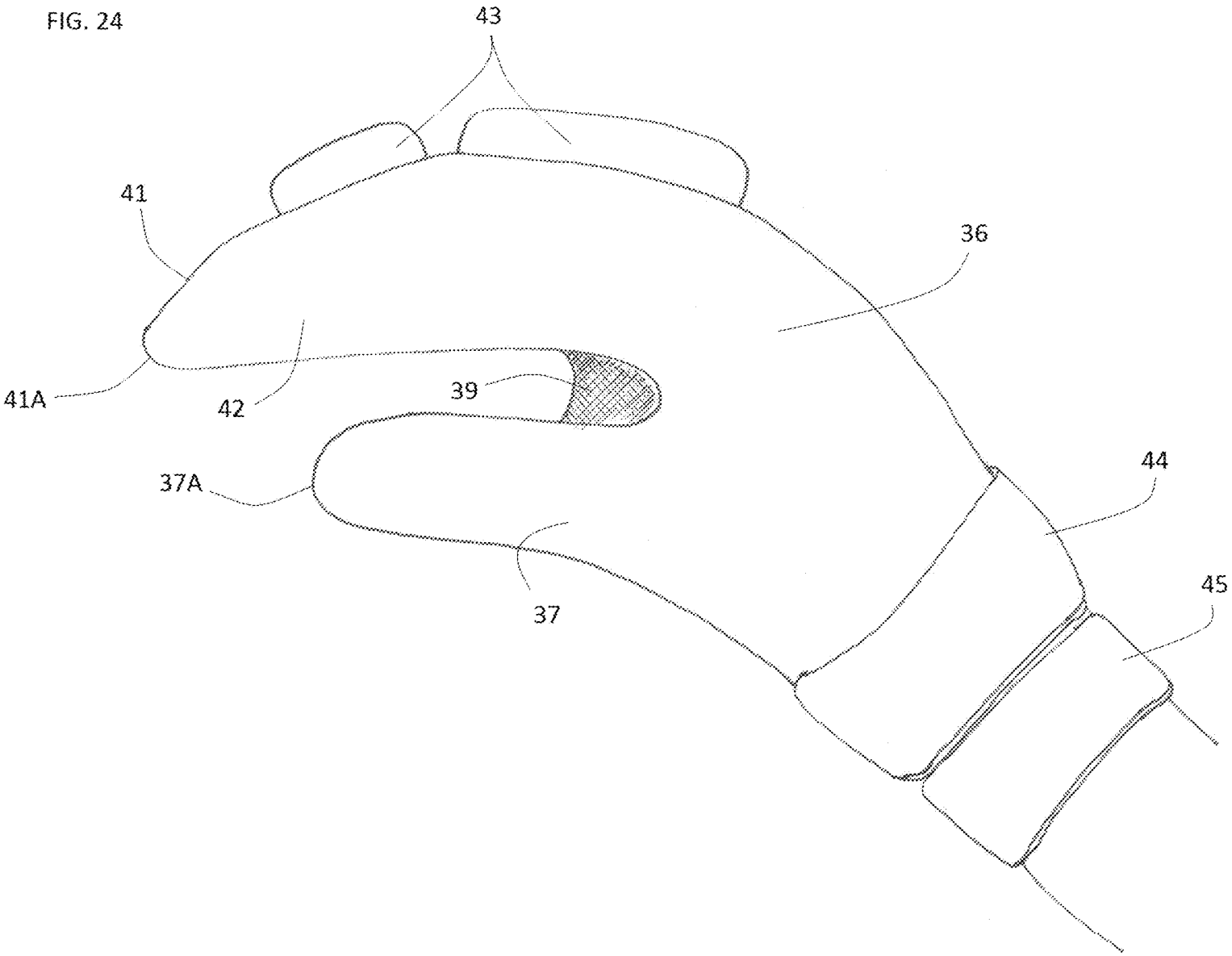
FIG. 24 is a side view of the glove shown in FIG. 22 illustrating the restrictive webbing between the thumb sheath and the index finger sheath.

FIG. 24 is a view similar to that illustrated in FIG. 22 showing the restrictive netting or webbing 39 between the finger sheath and the thumb sheath. This figure shows a hand in the glove when the human hand is in its natural or rest position.

Figure 25:
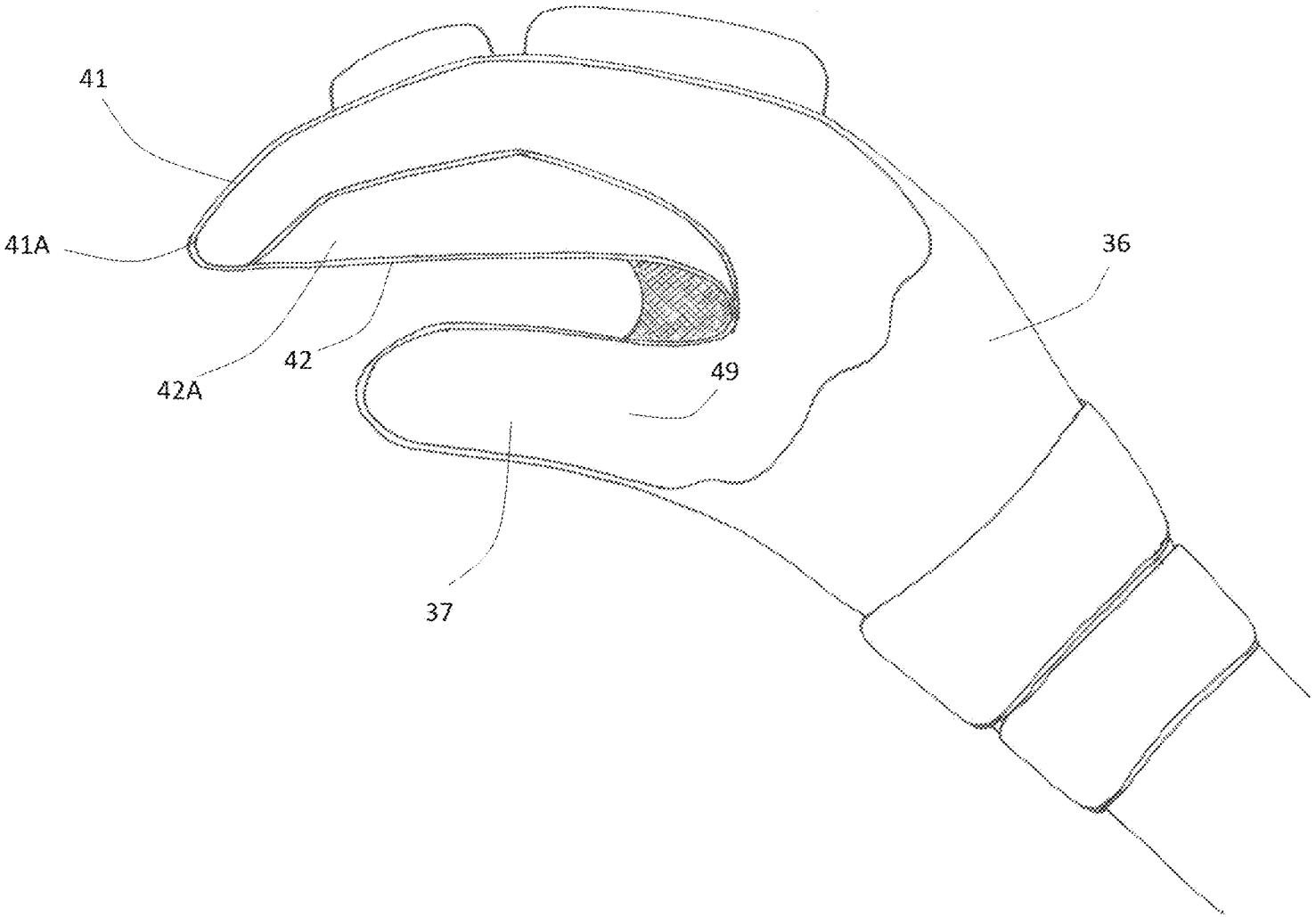
FIG. 25 is a partially cutaway section of the glove shown in FIG. 22 showing an internal finger sheath.
Figure 25A:
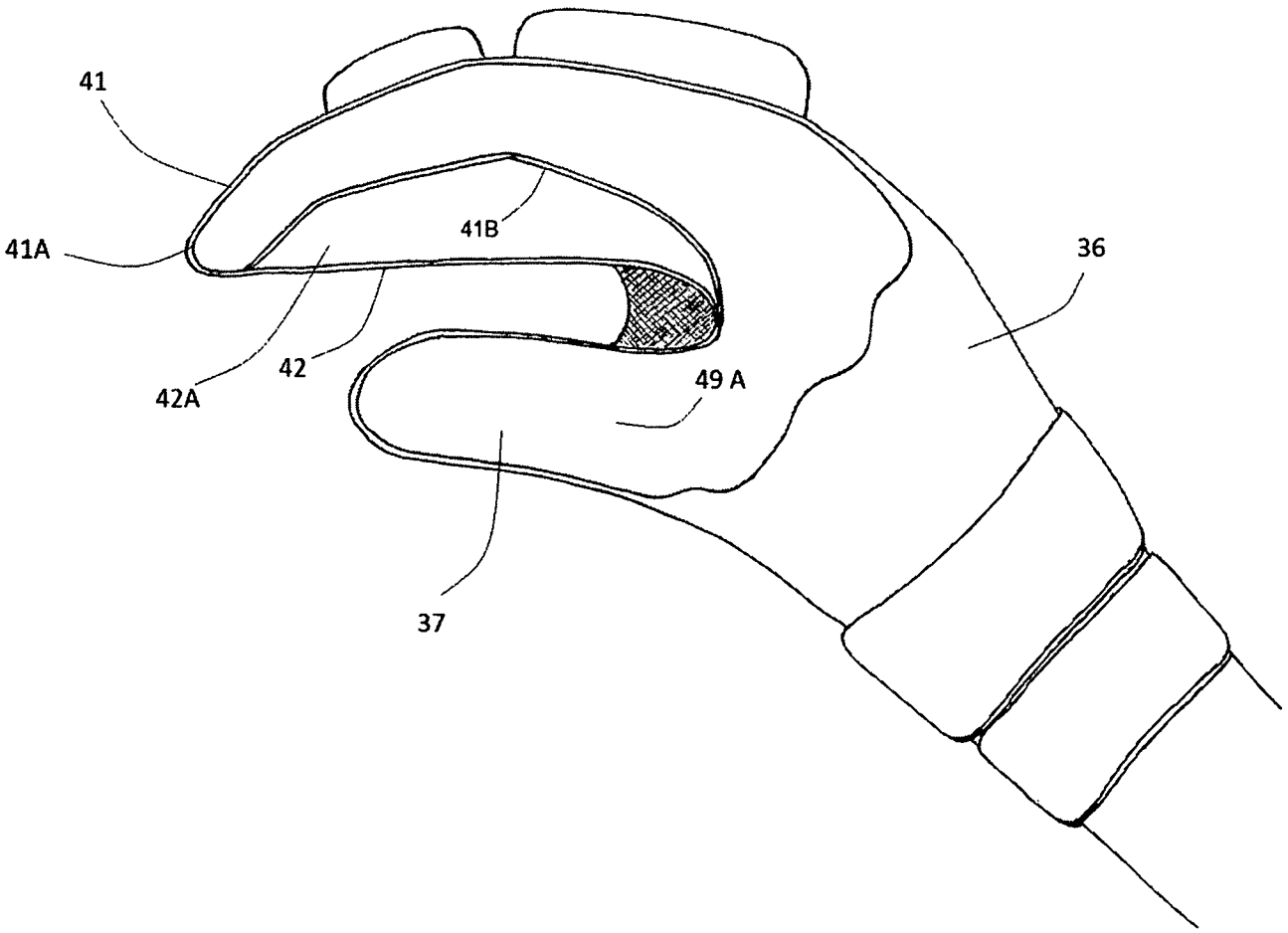

In FIG. 25, a cutout 49A is shown to expose the position allowed for the hand inside the glove 36. The figure also shows the finger sheath bottom surface 41B and the external material. This drawing clearly shows how the extension restriction is implemented with the extended palm material 42 attaching to the fingertip area 41A of the finger sheath 41.

Figure 26:
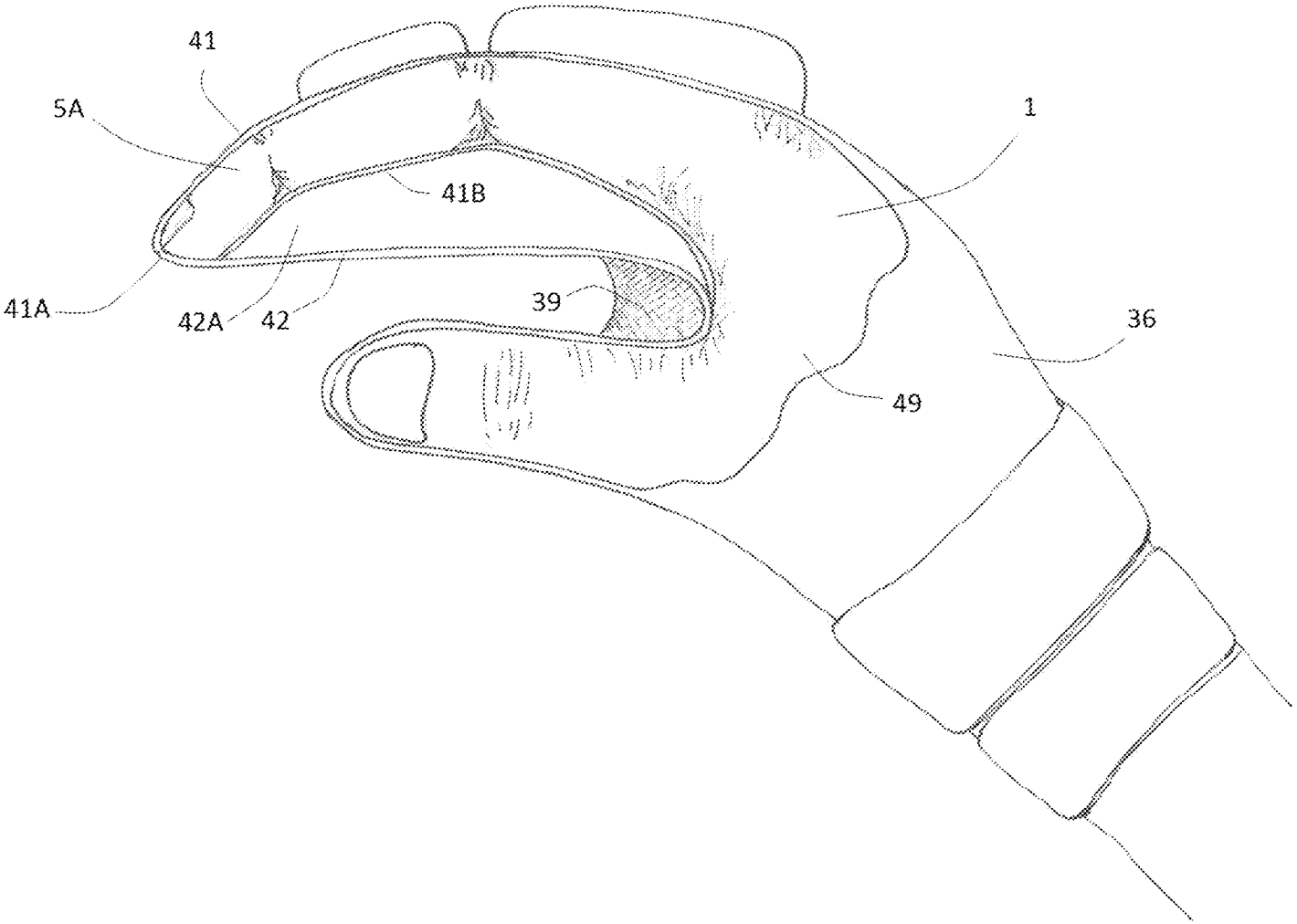
FIG. 26 is a further partially cutaway section of the glove shown in FIG. 22 showing the position of the hand inside the glove.
Figure 26A:
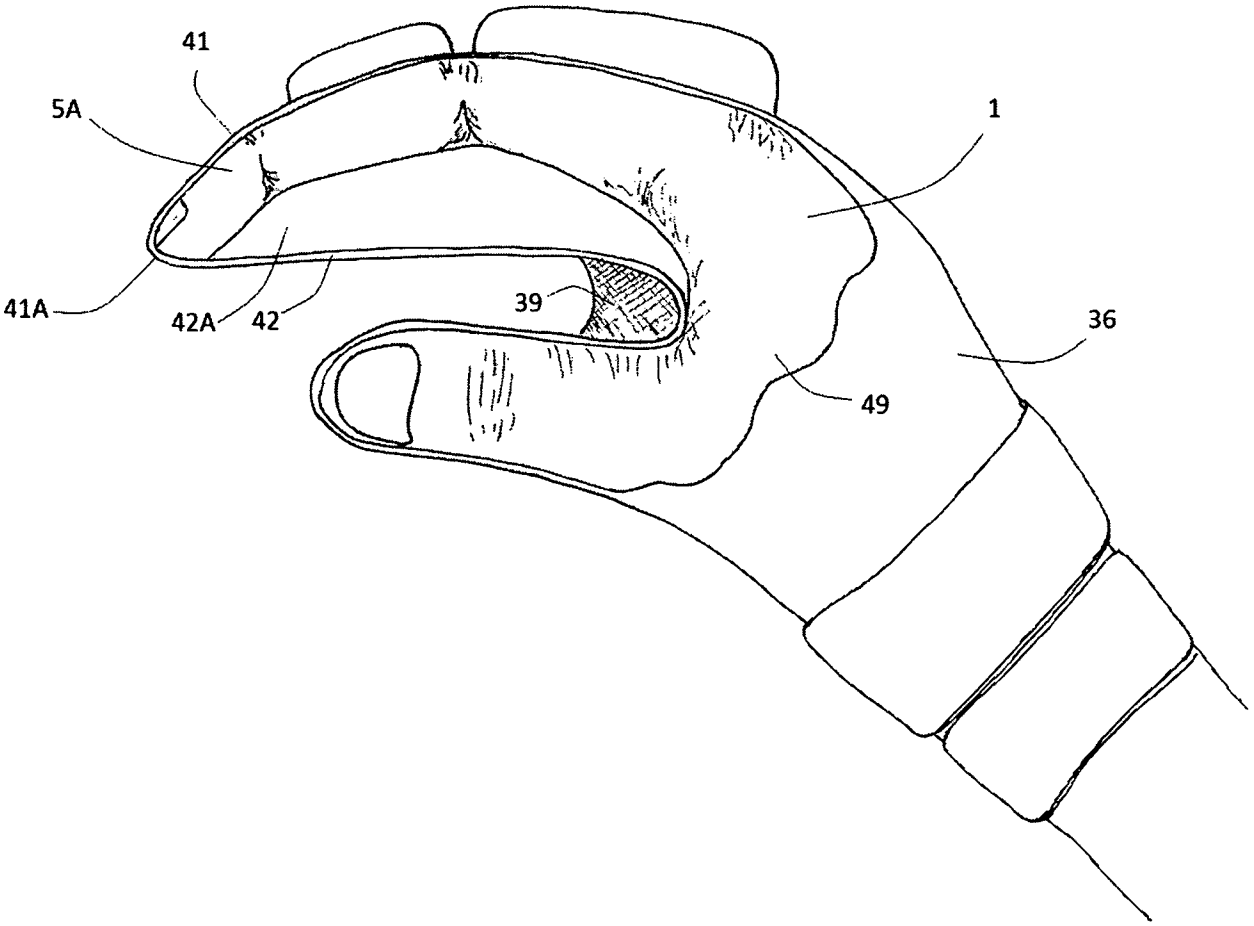

FIG. 26 shows a different embodiment with a hand 1 inside the glove 36. The finger sheaths having only top surface material and finger tip material, an outer surface material 42 for the palm, and a space 42A between, a finger and the palm surface material.

Figure 27:
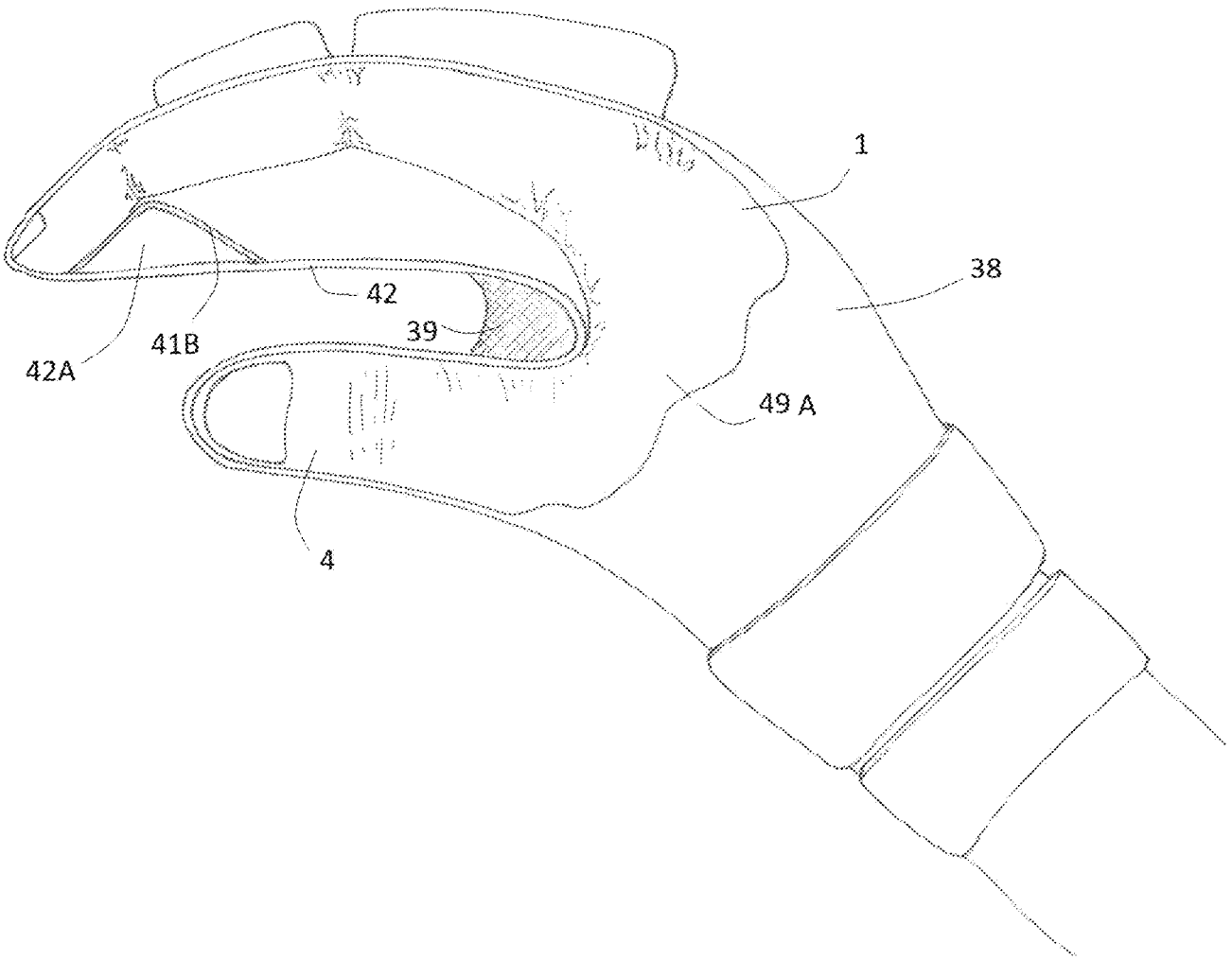
FIG. 27 shows a partially cutaway view of a glove in accordance with a further embodiment of the present invention.
Figure 27A:
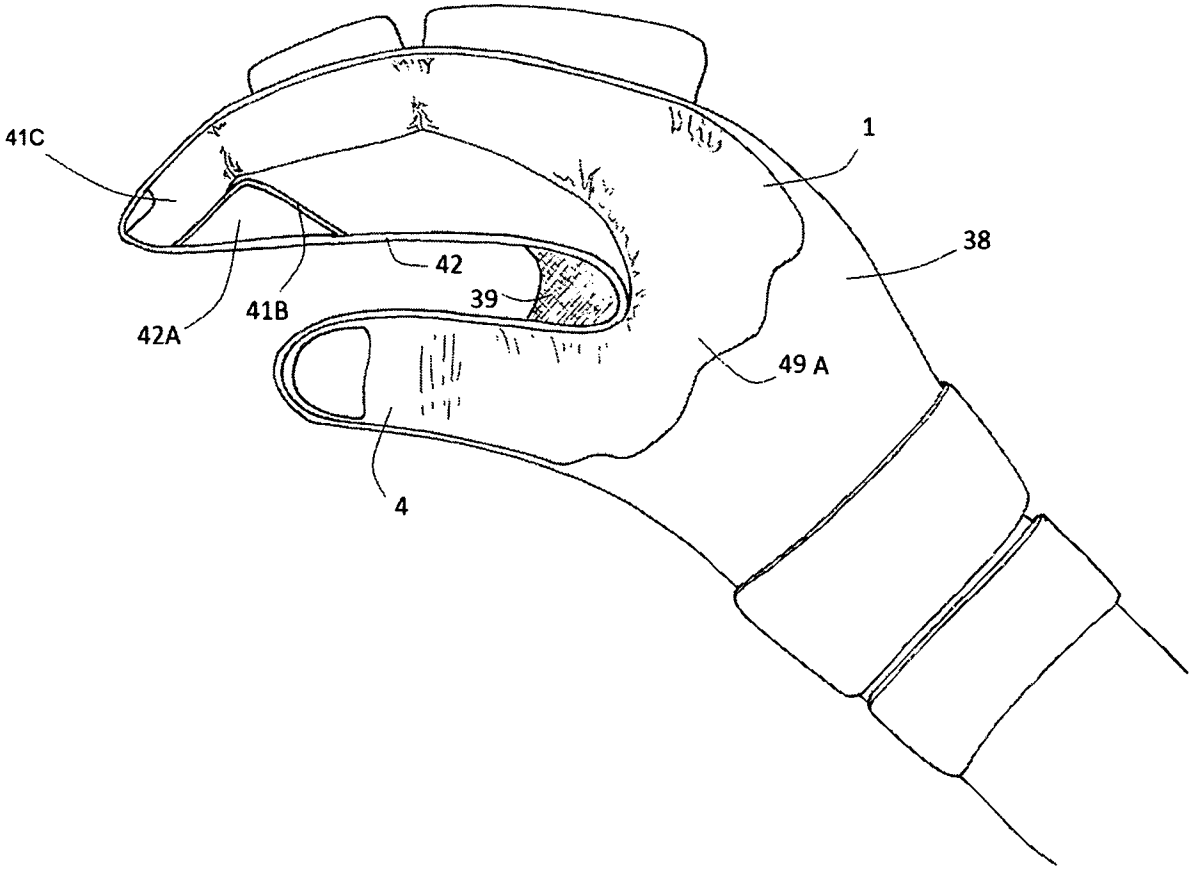

FIG. 27 shows a further embodiment of a glove in accordance with the invention, addressing the issue of potential excess material when the hand is in the clenched fist position. A finger sheath bottom material 41B has been reduced in size to reduce additional material from the palm area. The glove shows a small ramp 41B of bottom finger sheath material to guide the fingertip into the inner sheath finger tip pocket 41C. The finger sheath bottom material 41B is attached to the palm surface material 42 in a way which creates the ramp guide 41B for the finger. The area represented by reference numeral 42A, which is an internal non-usable area. FIG. 27 shows the hand 1, including thumb 4, inside the glove 38. Cutout 49 of the side panel illustrates the position of the hand inside the glove.

Figure 28:
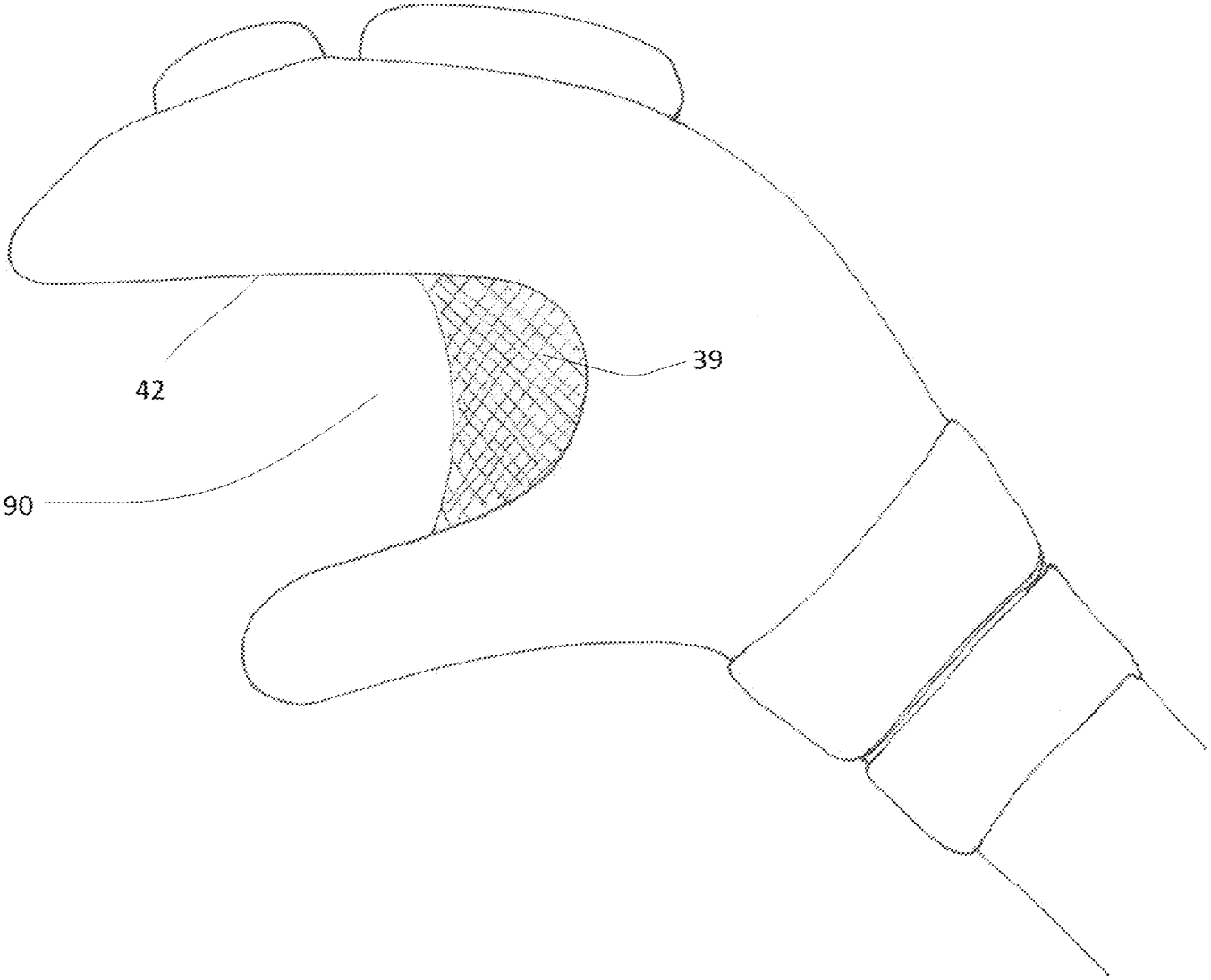
FIG. 28 shows a side view of a glove illustrated in FIG. 27 with the hand in a glove shown in an open position.
Figure 29:
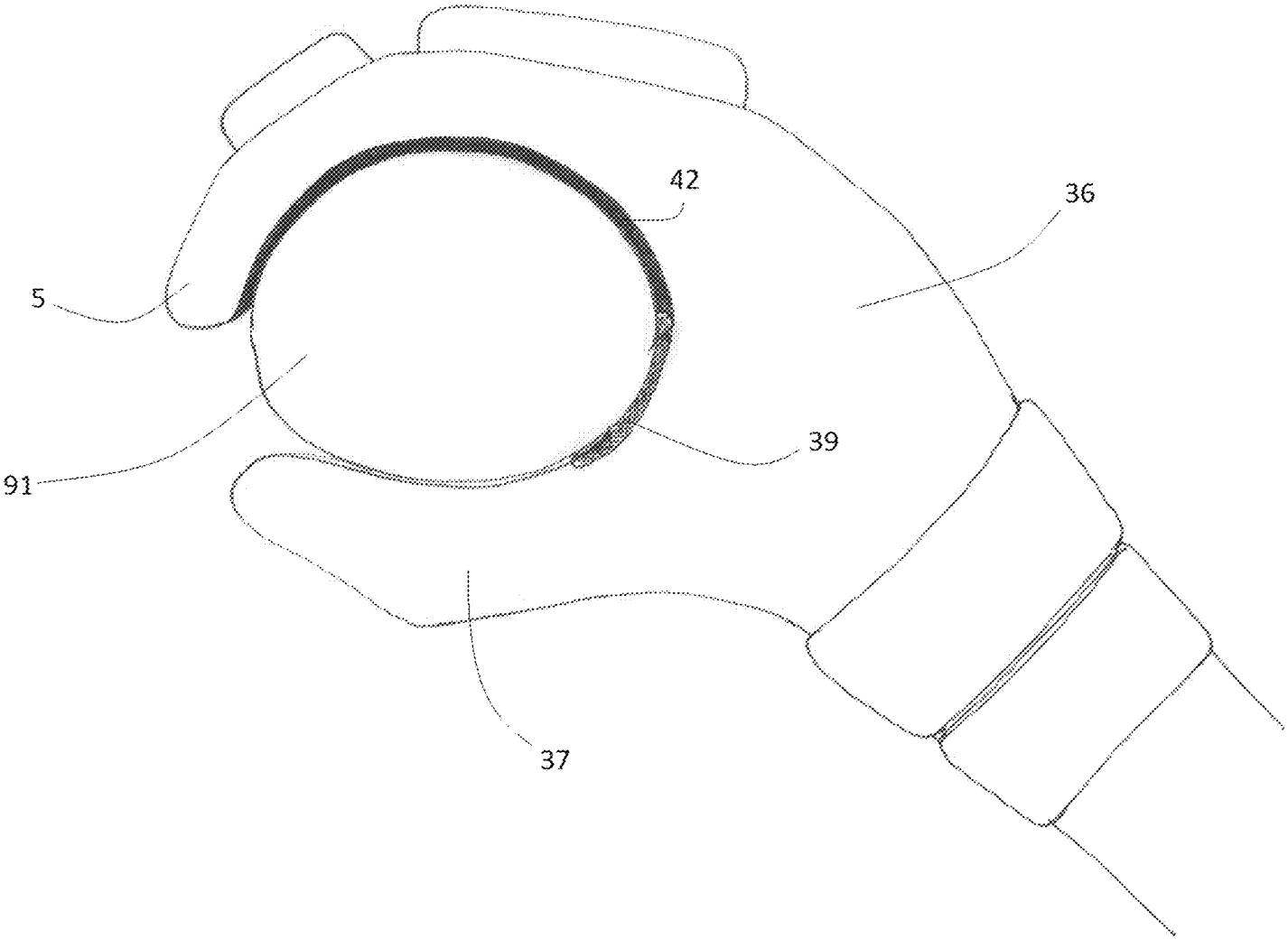
FIG. 29 shows a side view of a glove as illustrated in FIG. 27 with the hand grasping an item or object.

FIG. 28 shows a view similar to that in FIG. 27 with the hand open in a grasping position. There is seen the thumb sheath to finger sheath webbing 39, and a hand grasping area 90 between fingers and thumb. This figure illustrates how the webbing 39, or netting material, may stretch under the force or pressure. Note that this figure shows that it is the thumb sheath that is creating the opening in addition to the palm area of the hand structure, and not the fingers opening wider by extending to a straighter position. FIG. 29 shows a side view of a hand in glove similar to that in FIG. 28, grasping an item or object 91. This figure also shows the netting or webbing 39 and the palm material 42 compressing easily and out-of-the-way without creating bulk.

Figure 32:
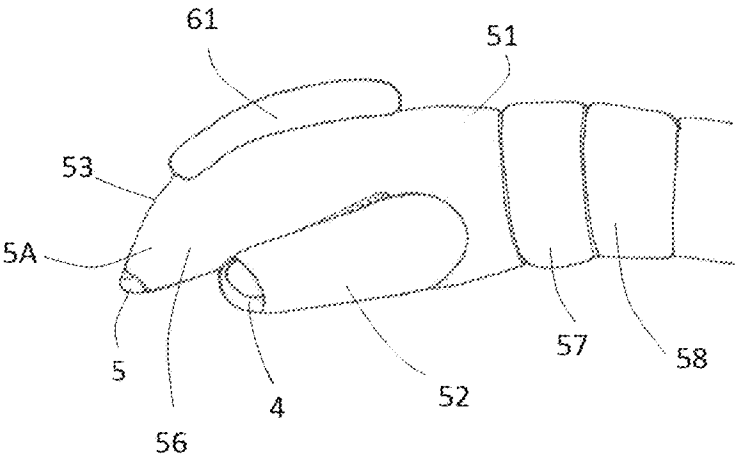
FIGS. 30, 31, 32 and 33 show a further embodiment of a glove in accordance with the invention, where the fingertips of the glove have been cut to allow the fingertips of the hand to extend therethrough.
Figure 33:
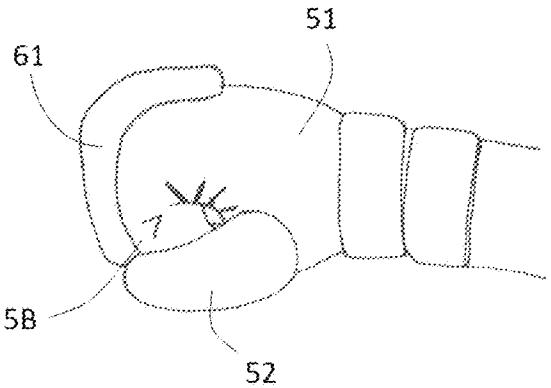
Figure 30:
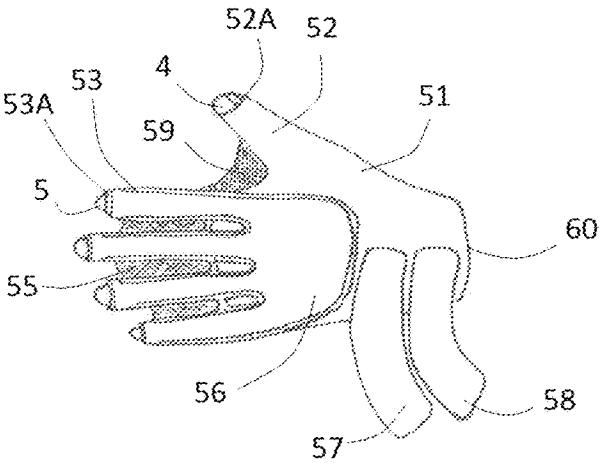
Figure 31:
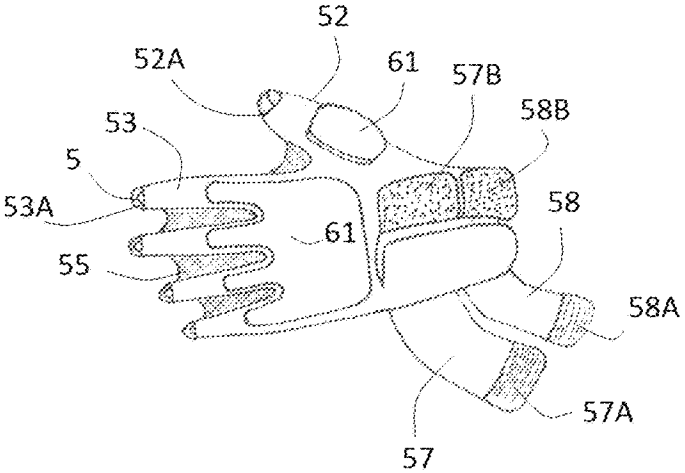
Figure 34:
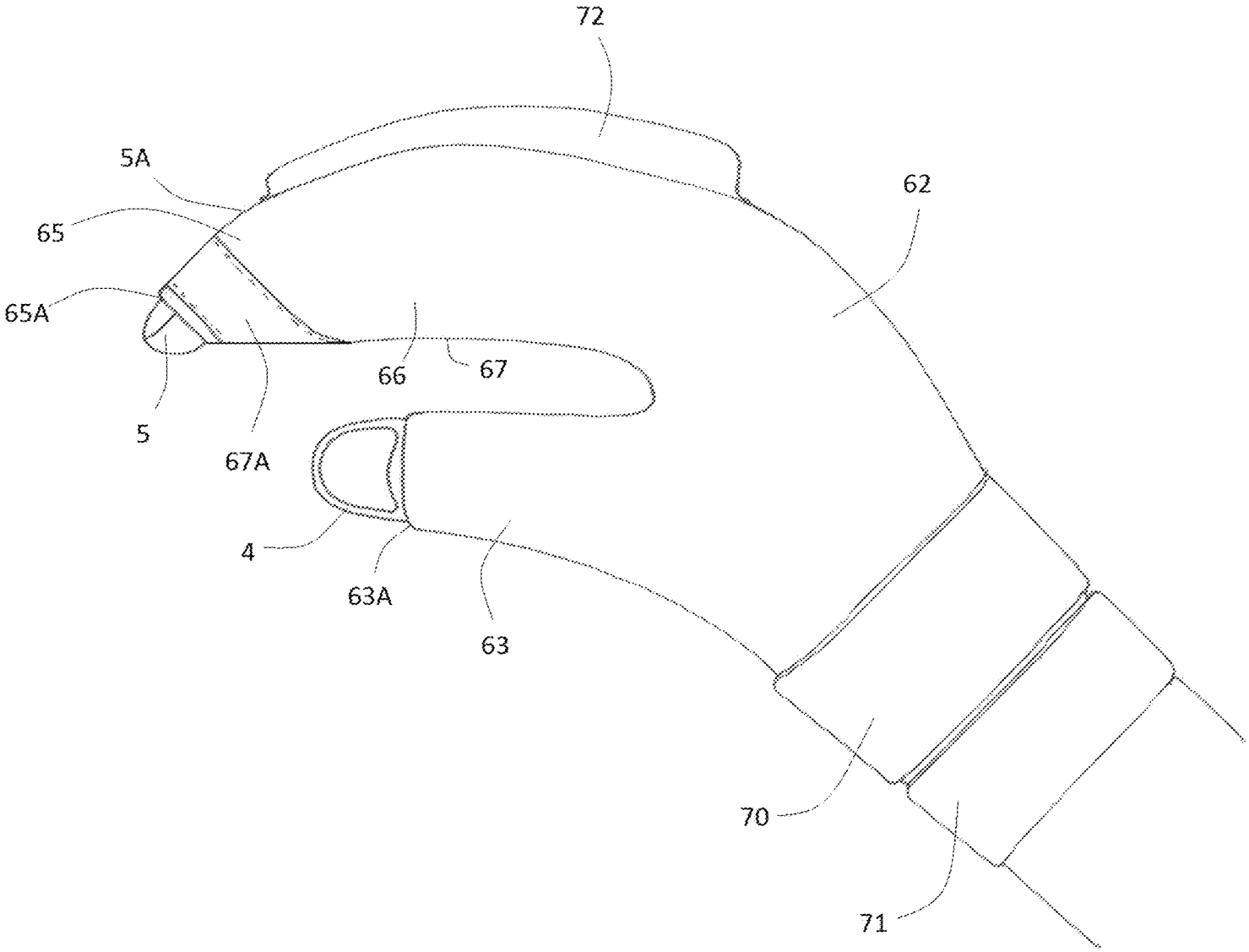
FIG. 34 is a side view of a glove in accordance with a further embodiment of the invention.

FIGS. 30 to 33 show a further embodiment of the invention where the fingertips of the sheaths remain open to allow for differences in finger lengths. Such a structure also requires a change in how the restriction of the extension is structured. These figures show the same reference numbering, where applicable. The glove 51 includes a thumb sheath 52 including a thumb sheath opening 52A. Each finger sheath 53 has a finger sheath opening 53A. There is provided restrictive movement webbing 55 from finger sheath to finger sheath. The glove 51 has a restrictive outer surface material 56 on the palm area, an upper fastening strap 57 and a lower fastening strap 58. A restrictive webbing 59 is provided between the finger sheath and the thumb sheath. A hand entry opening 60 is formed at one end of the glove 51. Knuckle padding 61 is provided. Fastening material 57A releasably attaches to fastening material 57B, and fastening material 58A attaches to fastening material 58B. FIGS. 30 and 31 show different sides (top and bottom/palm) of the glove respectively, while FIGS. 32 and 33 show a user's hand in the glove in a natural position and a clenched position respectively.

FIGS. 34 to 38 of the drawings show a further embodiment of the invention. This embodiment shows a palm material 42, now having reference #67, and siding material 66. A part 67A of the palm material 67 is wrapped out and around the end of the finger sheath side and top material, allowing for the size of the fingertip of the sheath to be adjusted while remaining open while the palm material confines the finger sheath to an arc similar to that of a hand at rest as the palm material also restricts the finger sheath from straightening.

These figures show a glove 62 including a thumb sheath 63 and finger sheath 65. A thumb sheath tip opening 63A is provided, as is a finger sheath tip opening 65A. There is a finger sheath internal open area as well 66 and a restrictive outer palm surface material 67. Further, an upper fastening strap 70, a lower fastening strap 71, as well as knuckle padding are provided for the glove 62.

Figure 35:
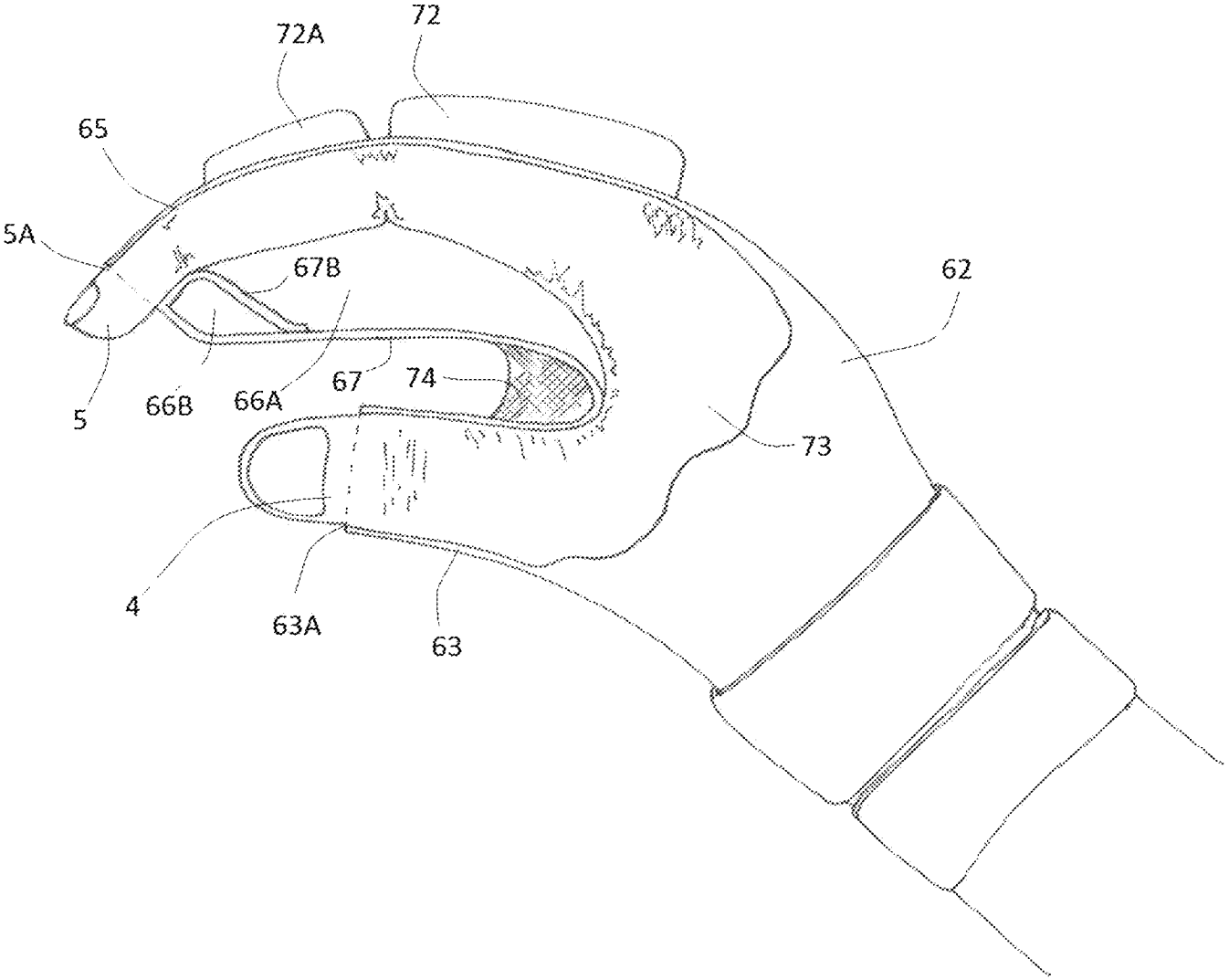
FIG. 35 shows a view of the glove illustrated in FIG. 34, partially cutaway to show a hand inside of the glove.

FIG. 35 shows a side view of the glove in accordance with this embodiment, with a portion cutaway to illustrate the position of the hand within the glove 62, including the thumb and finger tips extending through the finger and thumb sheath openings. The natural position 5A of the fingers 5 is shown. This figure also illustrates the finger sheath internal open space 66A, and the finger sheath internal ramp area 66B, which is non-usable space. The restrictive outer palm surface material 67 further comprises the finger sheath internal ramp 67B. Knuckle padding 72 and 72A are provided, and the cutout 73 helps to illustrate the position and fit of the hand within the glove 62.

Figure 36:
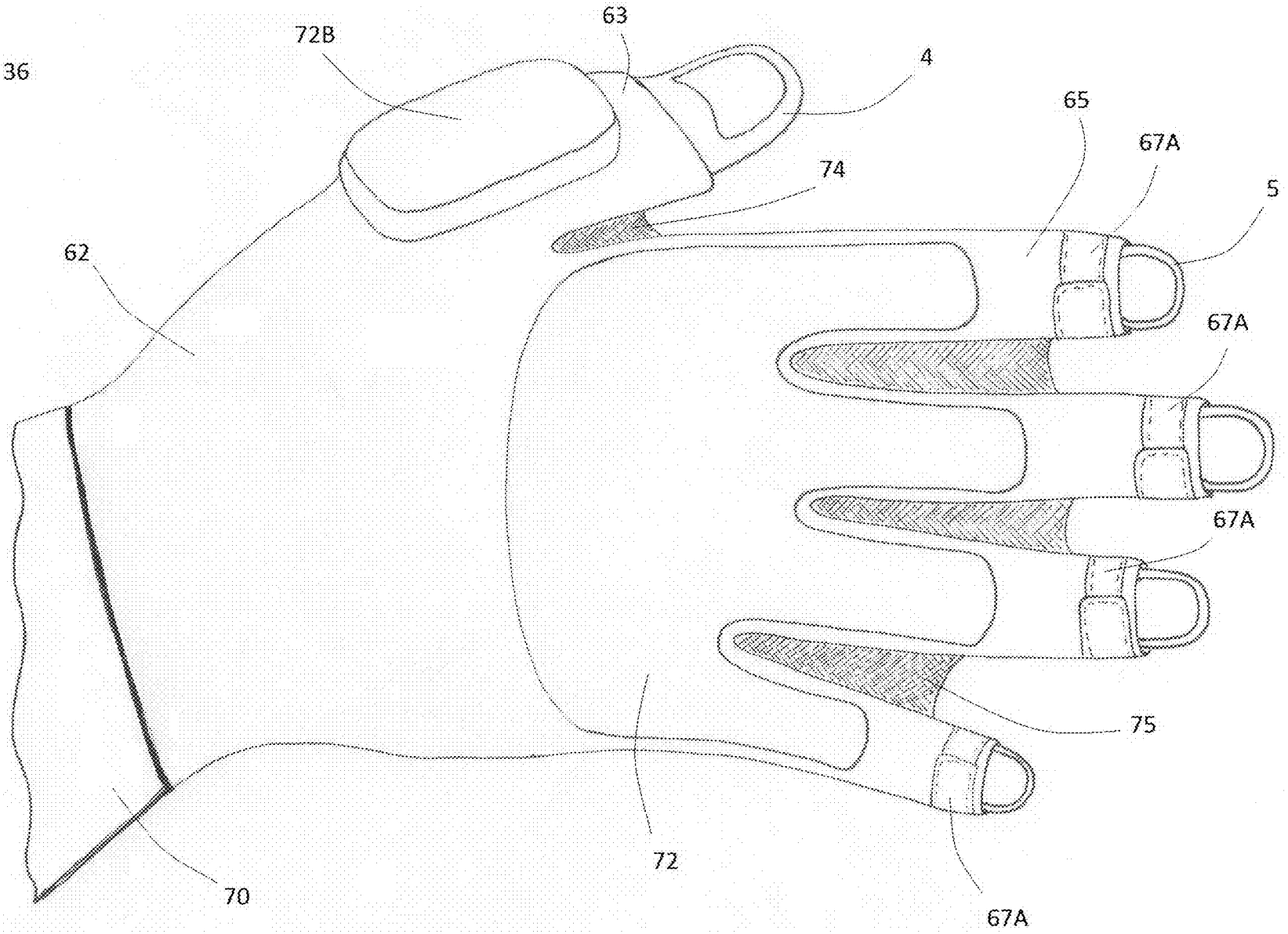
FIG. 36 illustrates a palm down view of the glove shown in FIG. 34 showing palm material wraps around the finger ends.

FIG. 36 shows a palm down view of an embodiment of the invention including a detailed showing the palm material wrapping 67A around the finger ends of the finger sheaths in order to control finger extension. A restrictive webbing 74 is provided between the finger sheath and the thumb sheath. Further, restrictive webbing 75 is shown between adjacent fingers sheaths.

Figure 37:
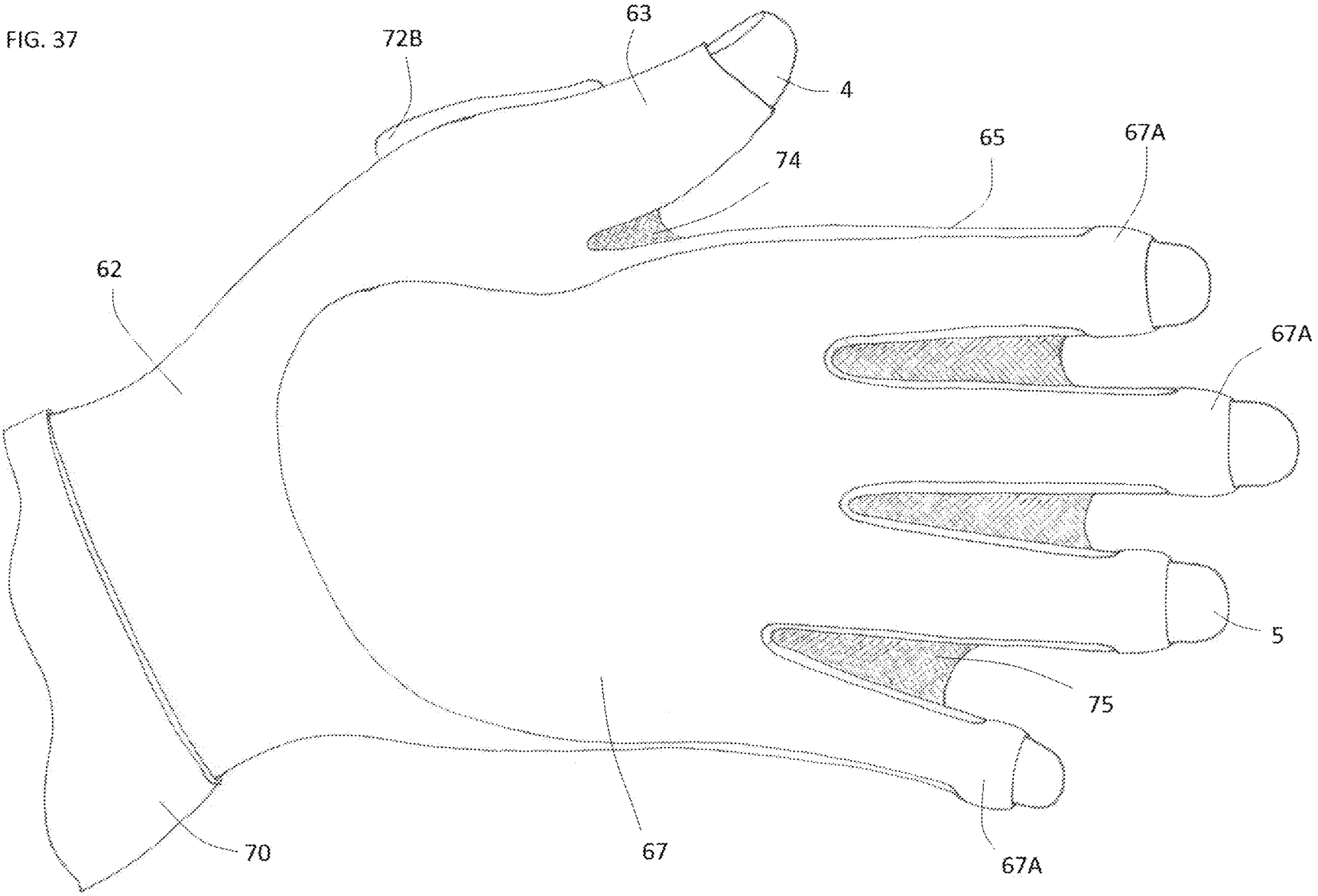
FIG. 37 illustrates a palm up view of the glove shown in FIG. 36 detailing the palm material.

FIG. 37 shows a palm up view of the glove 62, illustrating the palm material 67 and the wraparound 67A, along with the webbing 74 and 75.

Figure 38:
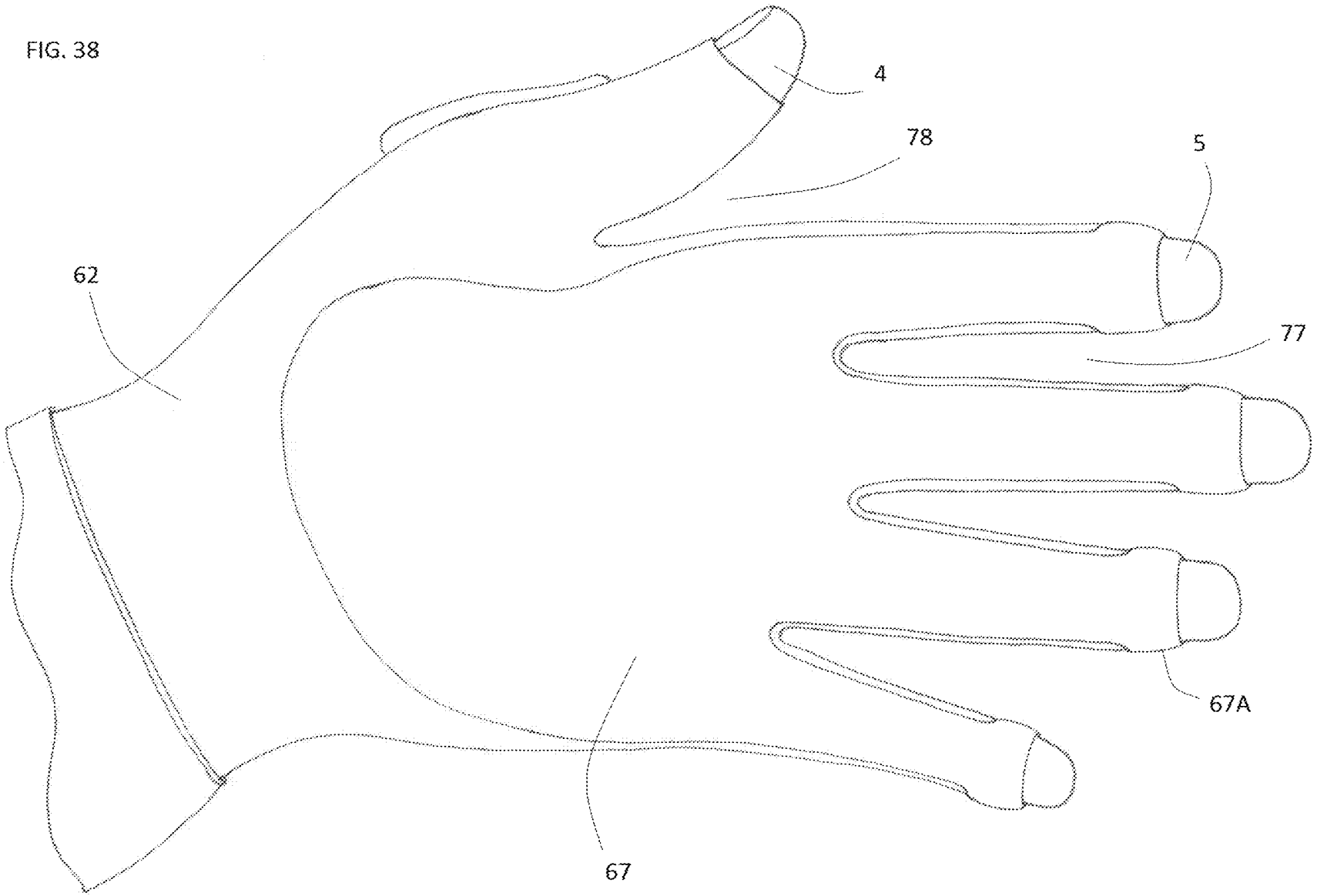
FIG. 38 illustrates a view similar to that shown in FIG. 37 without netting or webbing between sheaths.
Figure 39:
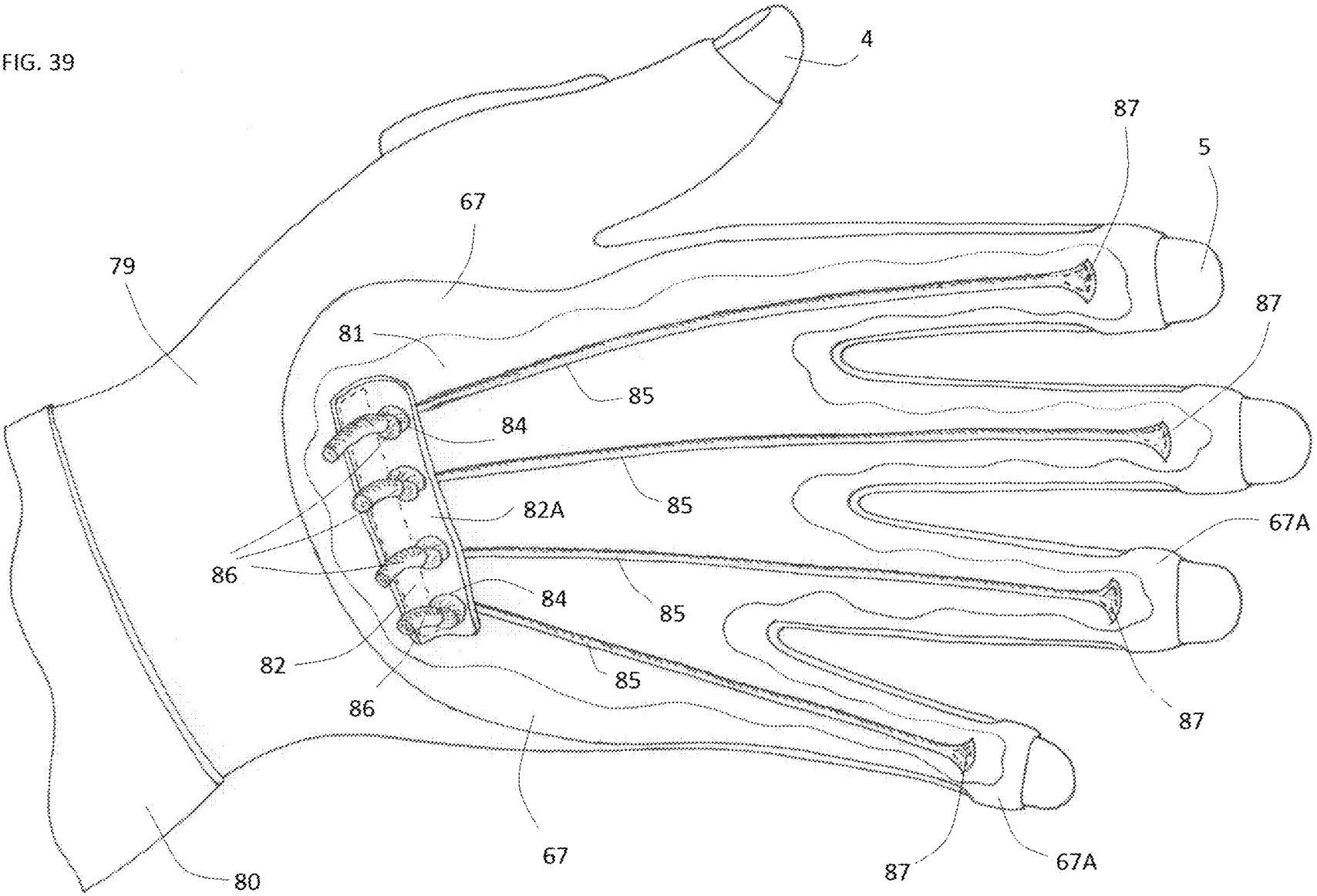
FIG. 39 illustrates a further embodiment of a glove in accordance with the present invention including cording.

FIG. 38 is a similar view to that shown in FIG. 37, but without the netting or webbing between the sheaths. This is apparent from the unrestricted spaces 77 and 78 between the fingers sheaths and between the finger sheath and thumb sheath respectively.

FIGS. 39 to 42 show yet a further embodiment of the present invention. In this embodiment, a system is provided whereby the amount of restriction in the extension of the finger sheath is adjustable by the user. This may be useful in the professional fighting arena where consistency for fairness is essential. The adjustability of the glove in this embodiment ensure that each competitor's finger extension restriction amount is the same. These figures are similar to those shown in the previous embodiment, with the exception that the netting or webbing has been removed. The glove 79 in this embodiment includes an upper fastening strap 80, a palm surface cutout 81 to reveal an internal tightening system, and a cloth folded mounting tab 82. A mounting tab upper flap 82A with mounting holes is provided for adjusting the cording 85. Cord mounting eyelet holes 84 are provided, and each cord 85 terminates with a cording knot 86. At the opposite end, the cording 85 has flattened and sewn cording ends 87. It will be appreciated that utilizing knots to adjust finger sheath restriction is just one way of effecting adjustment.

Figure 40:
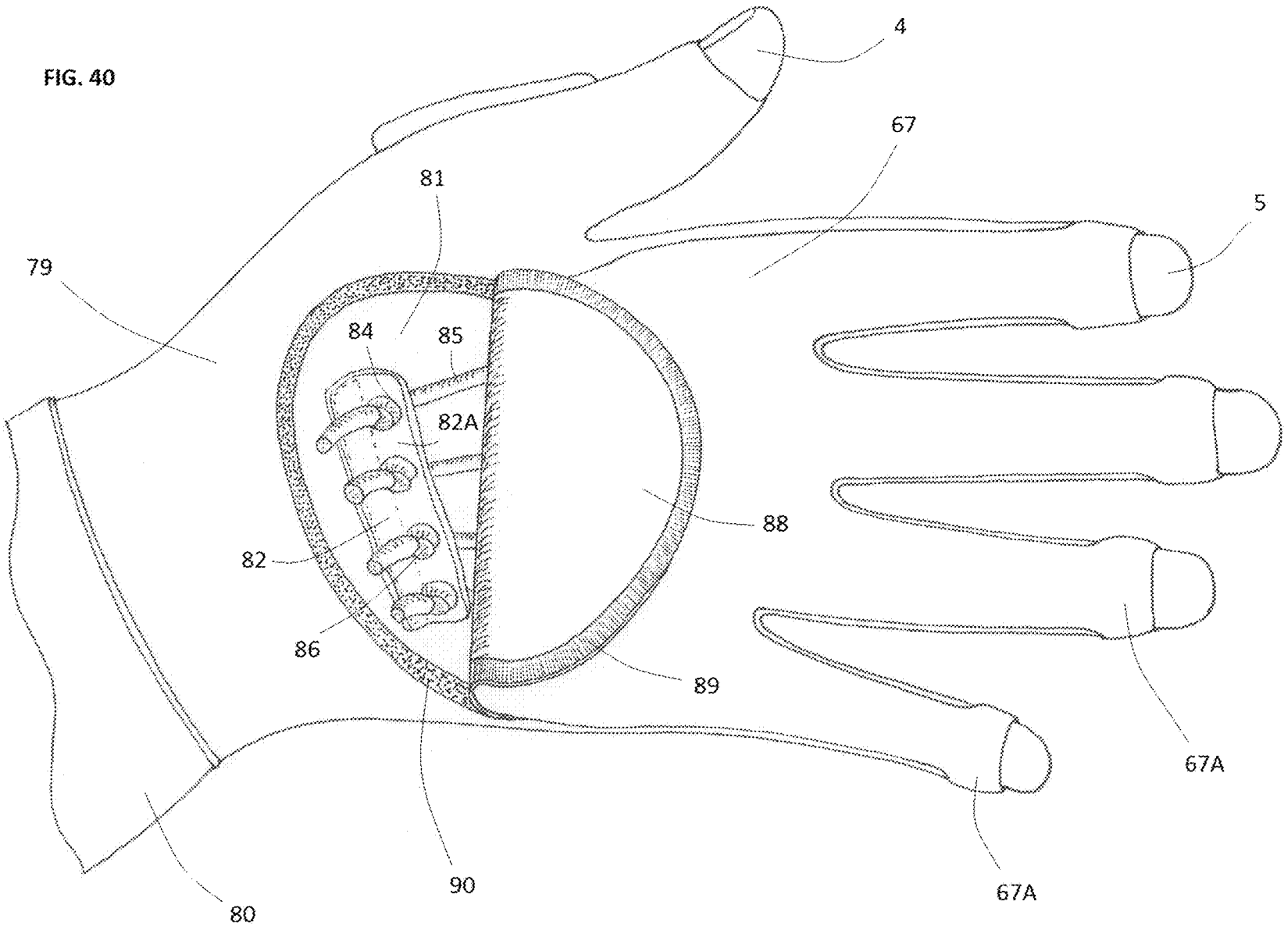
FIG. 40 illustrates a glove as shown in FIG. 39 showing an access flap in an open position to provide access to the adjustable cording.

FIG. 40 showing the cutout reveal 81 allowing for internal viewing, the user can see the mounting fixture 82 comprised of a pliable but strong material that allows the cording to be weaved and adjusted for restriction angle. A knot is tied to attain the desired level of restriction by appropriately manipulating the length of the cording 85.

FIG. 40 shows the glove 79 with the access flap opened. It may be held closed by Velcro material or by some other fastening or connecting mechanism. FIG. 40 illustrates the access flap 88 which provides access for adjusting the internal restriction system. The attachment material 89 corresponds with the attachment material 90, which together may be of Velcro, and operate to keep the access flap 88 closed when no access is required.

Figure 41:
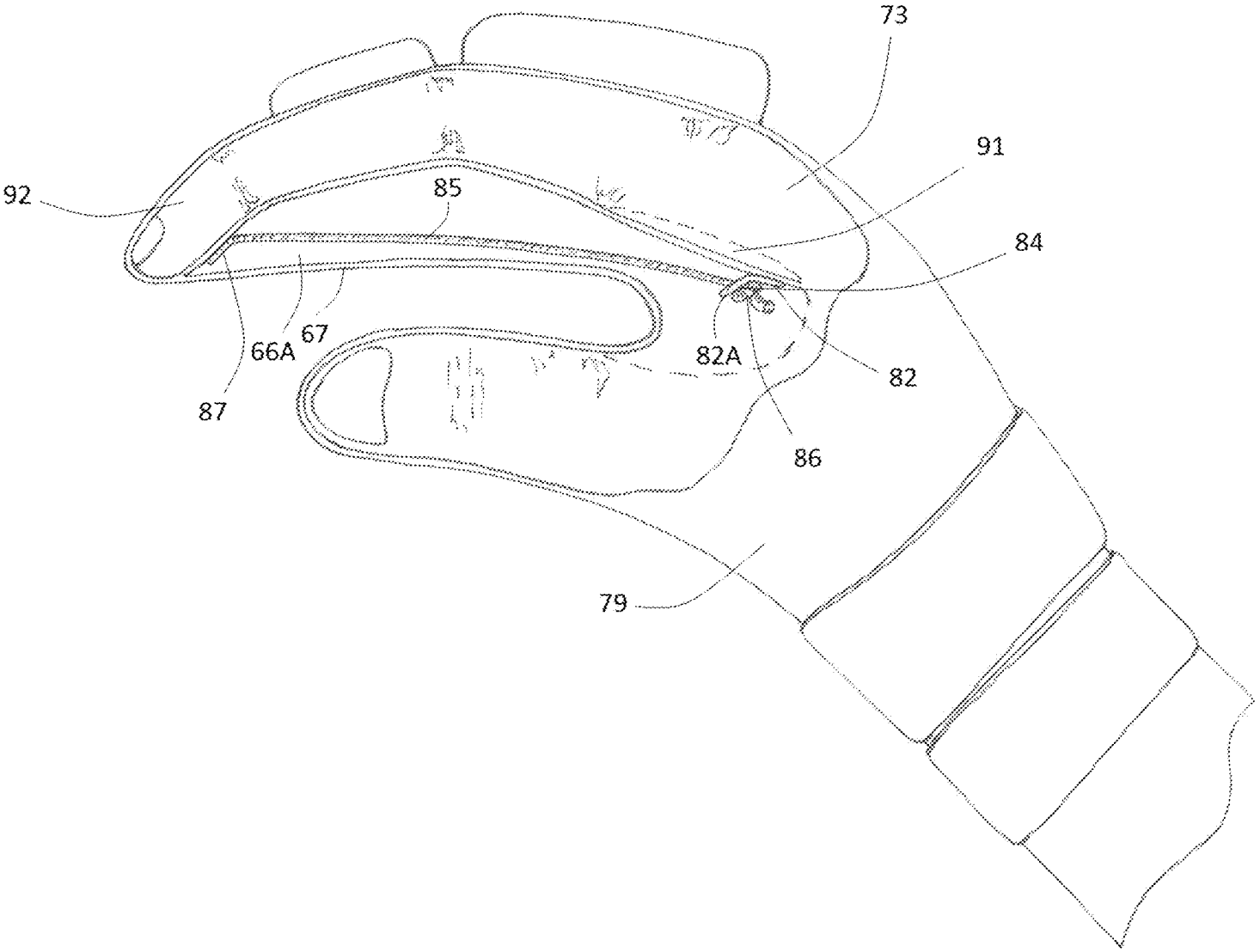
FIG. 41 illustrates a partially cutaway section of the glove illustrated in FIG. 40 including mounting tabs and cording.
Figure 41A:
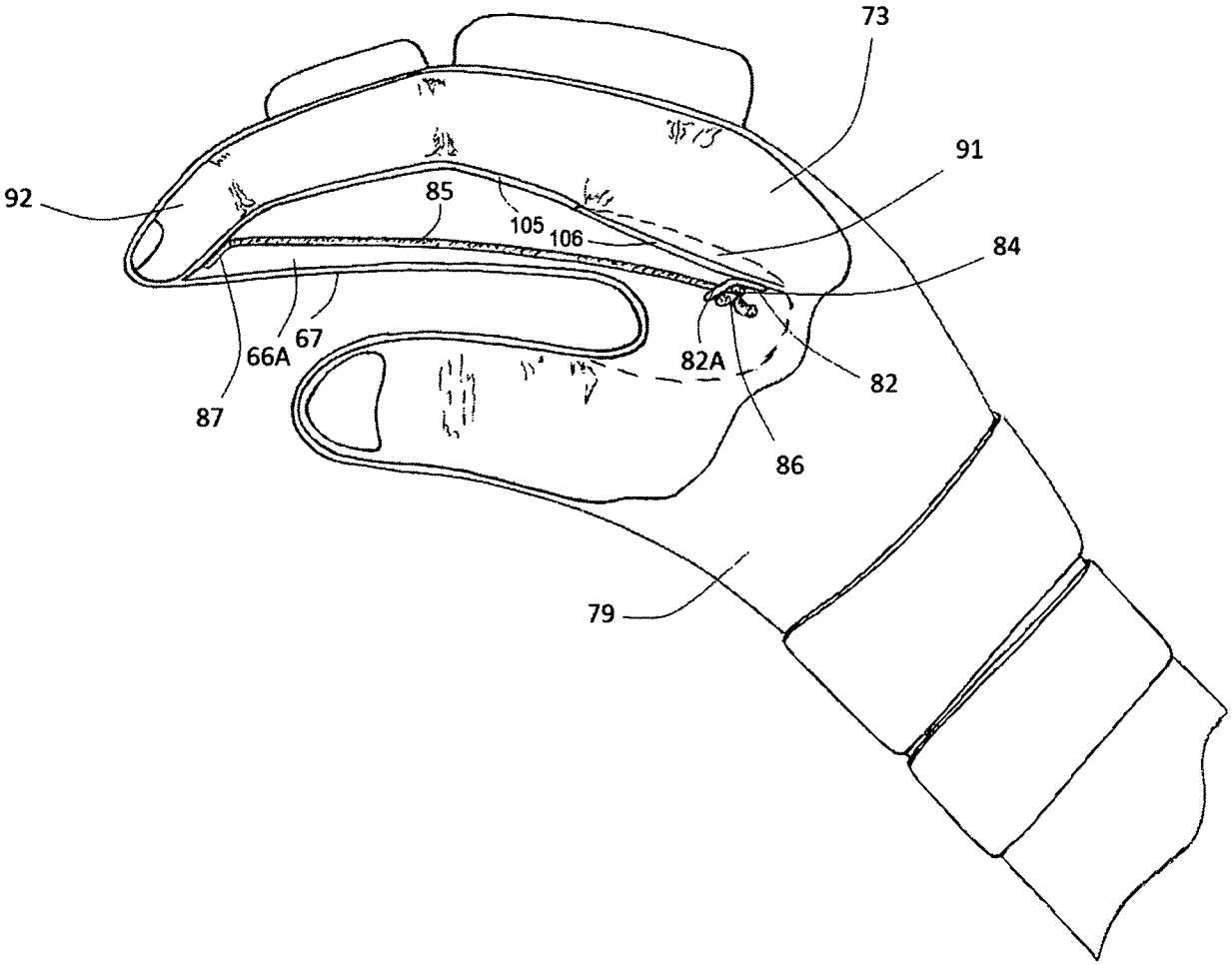

FIG. 41 shows a partially cutaway side view including a an additional deeper level cutout 91 which provides a view through the skin of the hand that is between the thumb and index finger. It can be seen in this figure how the mounting tab 82 attaches to the access flap 81. The natural angles of the finger, as shown by reference numeral 92, is illustrated, and this figure clearly shows the effect of the cording 85 in restricting the user from straightening or expanding the fingers.

Figure 42:
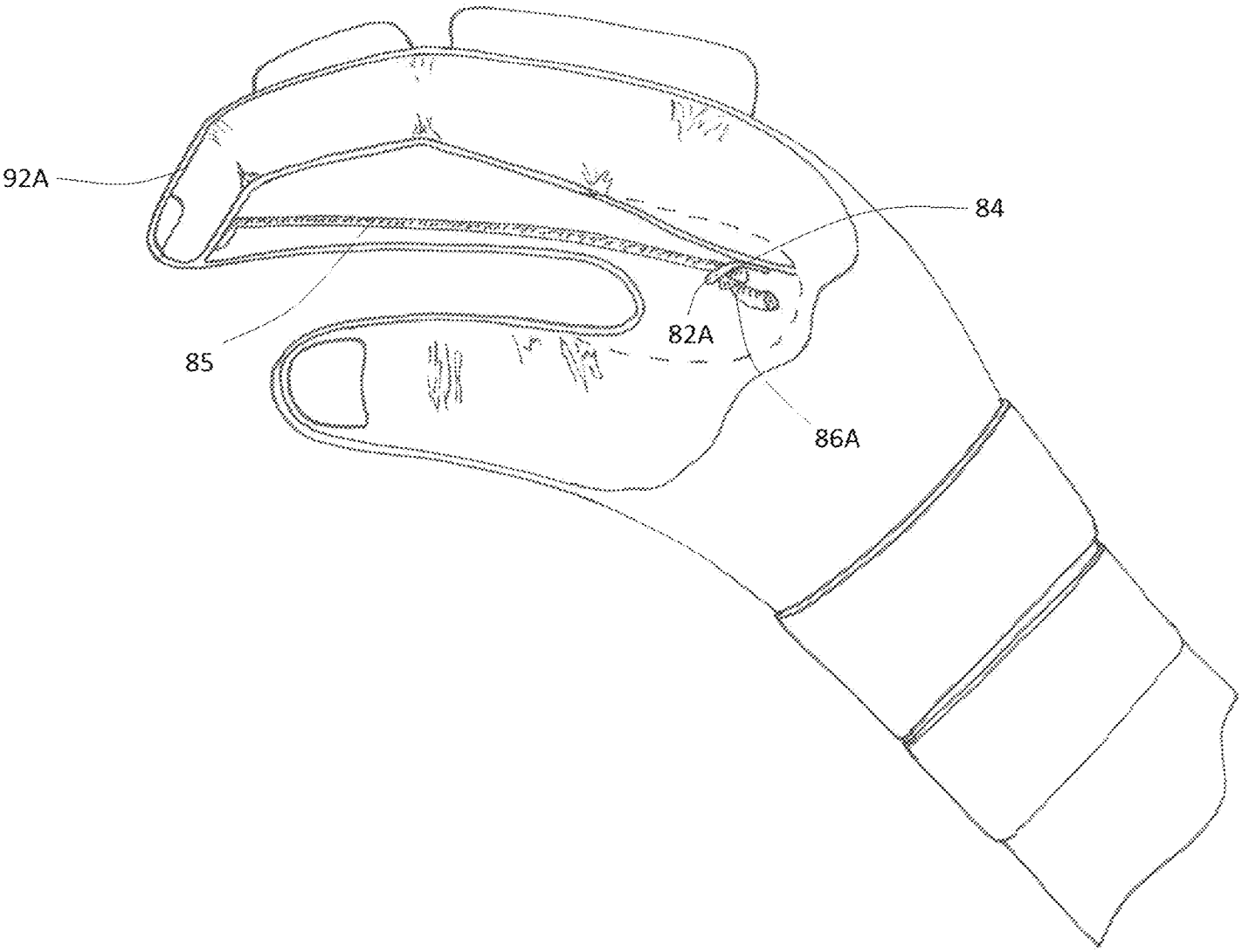
FIG. 42 illustrates a partially cutaway section of a glove similar to that illustrated in FIG. 41 illustrating a different length of the tail of the knot and showing a more severe angle to the finger and sheath itself.

FIG. 42 shows a view similar to that in FIG. 41. A cording knot tail 86A is showing a tale which is longer than shown to be in FIG. 40 because the finger sheath is pulled more tightly making the arc of the finger sheath smaller. Clearly, the tail will be longer when the knot is further up the cording, and vice versa. FIG. 42 shows that the cording 85 has been pulled close to be of shorter effective length to adjust the finger sheath restriction angle. Reference numeral 92A helps illustrate the angle to which the finger sheath has been restricted by the cording when compared to #92 of FIG. 41, having been pulled shorter and tied in place through the mounting tab holes 84 in the mounting tab 82.

Figure 43:
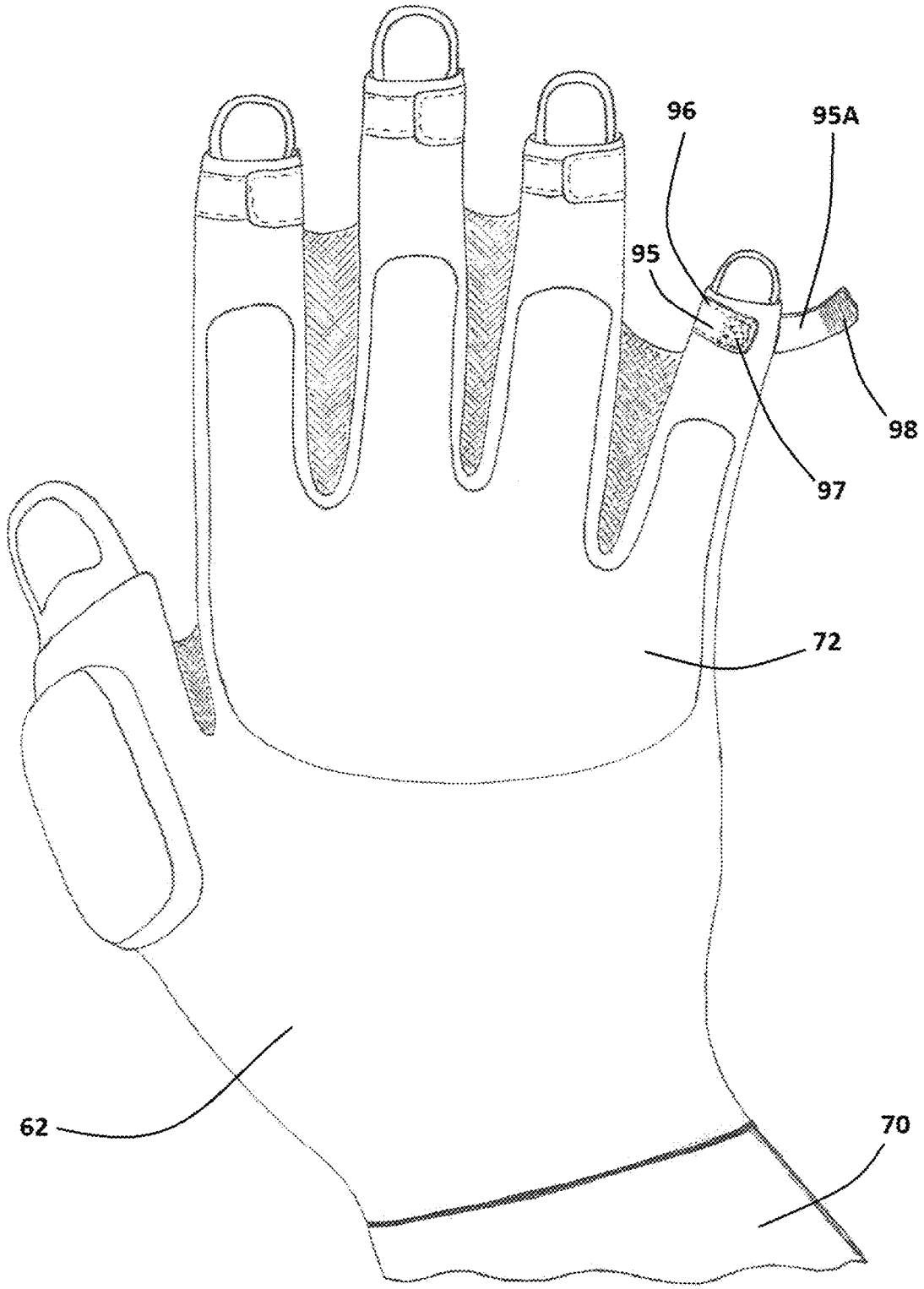
FIG. 43 of the drawings illustrates a glove incorporating an adjustable fingertip control wrapping.
Figure 44:
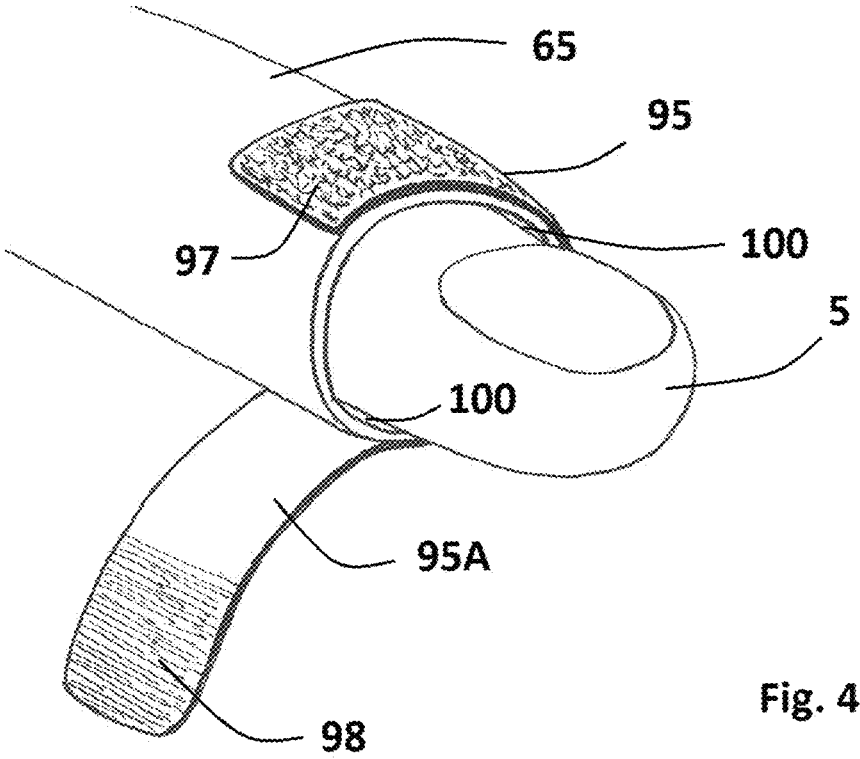
FIG. 44 of the drawings shows a detail of the adjustable finger tip control wrapping in the unfastened condition.
Figure 45:
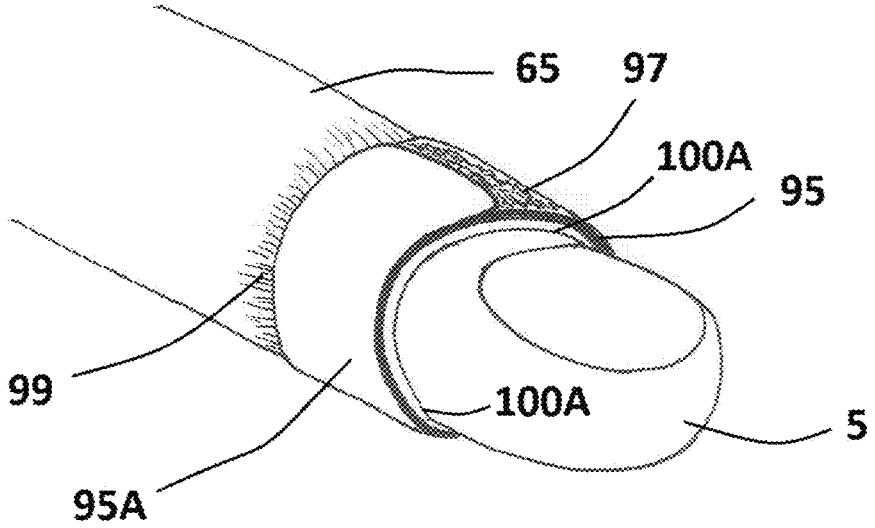
FIG. 45 of the drawings shows a detail of the adjustable fingertip control wrapping in the fastened condition.

FIGS. 43, 44 and 45 show an embodiment of the invention which incorporates an adjustable fingertip control wrapping. The purpose and function of the control wrappings is to better accommodate fingers which may be thinner or smaller in circumference than the actual finger sheath end opening. By adjusting this wrap after the hand is in the glove, the wearer's finger will be snugly accommodated within the sheath of the glove to facilitate operation of the glove at its maximum design efficiency.

In FIG. 43, there is shown a glove including an upper fastening strap 70, knuckle padding 72, and an adjustable fingertip control wrapping. This is comprised of the secured end of an adjustable restrictive fingertip control wrapping 95, and the adjustable end of the adjustable restrictive fingertip control wrapping 95A, the position of which can be varied to alter the size at or near the finger opening. The securement end stitching 96 insures an effective fastening to the glove. The fingertip control wrapping includes a fastening strap Velcro material 97 (male side) and the fastening strap contact adhesion material 98 (female side). The adhesion material 98 can be placed on the Velcro material 97 in different ways and locations so that the finger opening remains at its maximum size, or where a part of the finger sheath under the material 97 and 98 will be squeezed slightly to make the finger opening smaller. An appropriate adjustment can be made based on the thinness or circumference of the fingers. This embodiment therefore offers an additional layer of fit, so that the maximum comfort and efficiency of the glove can be utilized.

In FIGS. 44 and 45, a detail of the fingertip control wrapping is illustrated. FIG. 4 shows the wrapping in the unwrapped condition, while FIG. 45 shows the wrapping in the secured position, adjusted for the circumference of the wearer's finger. These figures illustrate a finger 5 in the finger sheath 65. The secured end of the adjustable restrictive fingertip control wrapping 95 is releasably connected to the adjustable end of the adjustable restrictive fingertip control wrapping A fastening strap of Velcro material 97 (male side) thus releasably engages with the fastening strap contact adhesion material 98 (female side). As best seen in FIG. 45, reference numeral 99 represents the finger sheath squeezed down to a smaller opening to provide a more complete and effective contact fit around the finger 5.

As will be appreciated, the present invention as described herein in its various embodiments can take a significant number of different versions and forms. Central to all of the embodiments is the provision of a glove which contains structure for restricting the movement of the hand or fingers when inside the glove. The glove of the invention will make it comfortable for the user's hand to be in a natural slightly curved position, as well as in a clenched or fisted position, but not one in which the user's fingers are straight, extended or linear, in a flat position. As mentioned above, when the fingers are straight or extended, this increases the probability of injury to both the opponent as well as the user of the glove.

The invention claimed is:

1. A glove comprising: a back surface having an entry end and a finger sheath connection end; a palm surface having an extended length and an entry end, and a finger sheath connection end; a multitude of finger sheaths each finger sheath having a top surface with a connection end, a fingertip portion, and a partial bottom surface being connected to the fingertip portion;

and a thumb sheath having a top surface, a fingertip portion, and a bottom surface;

the back surface and the palm surface attached and configured to receive a hand, the finger sheath top surface having a connecting end that is attached to the back surface finger sheath connecting end, the fingertip portion connected to the partial bottom surface of the finger sheath, the partial bottom surface of the finger sheath being significantly shorter than a length of the top surface of the finger sheath, each finger sheath being bent into an arc, the fingertip portion of the bent finger sheath attached to the finger sheath connection end of the palm surface, a connection between the finger sheath's fingertip portion and the palm surface connection end creates a permanent arc in the finger sheath restricting the ability for the finger sheath to be extended or straightened beyond the permanent arc when used, the partial bottom surface of the finger sheath having a ramp, the ramp configured to guide a fingertip of a user into a position in the finger sheath which completely encircles the finger of the user, the ramp having a bend configured between a distal and a middle phalanges area of the finger of the user when worn, the ramp being on the inside bottom of the finger sheath with the bend having an angle between 45 degrees and 90 degrees in a direction away from the finger sheath towards and connecting to the palm surface connection end, the finger sheath retaining the ability to grasp items as well as to be fully clenched into a fist position.

2. A glove as claimed in claim 1 further comprising knuckle padding formed on the back surface of the glove including on the top surface of at least one of the finger sheaths.

3. A glove as claimed in claim 1 further comprising at least one closure or strap for securing the glove.

4. A glove as claimed in claim 1 wherein the finger sheaths and the thumb sheath each have an open end configured to allow the tips of the fingers and thumb of the user to extend outside of the finger sheaths and thumb sheaths.

5. A glove as claimed in claim 1 wherein the fingertip portion of the finger sheath is open and configured to allow the fingertip of a user to be exposed.

6. A glove comprising: a back surface having an entry end and a finger sheath connection end; a palm surface having an extended length and an entry end, a finger sheath connection end; a multitude of finger sheaths each having a top surface with a connection end, and a fingertip portion with a connection end; and a thumb sheath having a top surface, a fingertip portion, and a bottom surface; the back surface and the palm surface attached and configured to receive a hand through the entry end, a finger sheath's top surface connecting end attached to the back surface finger sheath connecting end, the finger sheath being bent into an arc, allowing the connection end of the fingertip portion of the finger sheath to reach the finger sheath connecting end of the palm surface for attachment, the attachment of the finger sheath at the fingertip connection end to the finger sheath connection end of the palm surface restricts the range of motion of the finger sheath from being able to fully extend or straighten, the finger sheath retaining the ability to grasp items as well as to be fully clenched into a fist position.

7. A glove as claimed in claim 6 further comprising a restrictive outer palm surface control wrapping material at the fingertip portion.

8. A glove as claimed in claim 6 further comprising a palm surface having an extended length and an entry end, a finger sheath connection end, and a plurality of adjustable fingertip control wrapping components at or near the end of the finger sheath, the adjustable fingertip control wrapping components adjustably encompassing at least one finger sheath to vary the circumference of the finger sheath at a fingertip area for configuring to different finger sizes.

9. A glove as claimed in claim 8 wherein the adjustable fingertip control wrapping component comprises a strap having a releasable securement surface and a base on the sheath having a releasable securement surface, the strap and base being releasably connectable to each other to vary the circumference of the finger sheath at the fingertip area.

10. A glove as claimed in claim 6 further comprising knuckle padding formed on the back surface of the glove including on the top surface of at least one of the finger sheaths and at least one fastening strap for securing the glove.

11. A glove comprising: a back surface having an entry end and a finger sheath connection end; an inner palm surface having an entry end, and a finger sheath connection end;

an outer palm surface having an extended length that is longer than the inner palm surface and wider than the inner palm surface, having an entry end and a finger sheath tip connection end, the entry end of the outer palm surface attached on top of and to the entry end of the inner palm surface;

a multitude of finger sheaths each having a top surface, a fingertip portion, and a bottom surface; and a thumb sheath having a top surface, the fingertip portion, and a bottom surface; the back surface and the inner palm surface attached and configured to receive a hand each finger sheath positioned in an arc, which allows the fingertip portion of the finger sheath to reach the connection end of the outer palm surface for attachment, the attachment of the finger sheath at the fingertip portion to the connection end of the outer palm surface which restricts the range of motion of the finger sheath from being able to fully extend or straighten, an additional width of the outer palm surface extending beyond the width of the inner palm surface on both sides of the inner palm surface closes the gap between the arc of the finger sheath's bottom surface and the outer palm surface, the finger sheaths retain the ability to grasp items and to be fully clenched into a fist.

12. A glove as claimed in claim 11 wherein the fingertip portion is open and configured to allow a fingertip of a user to be exposed.

13. A glove comprising: a back surface having an entry end and a finger sheath connection end; an inner palm surface having an entry end, a finger sheath connection end, and a cord mounting tab; an outer palm surface being longer in length than the inner palm surface, wider than the inner palm surface, having an entry end, a finger sheath tip connection end, and incorporating an access flap, the entry end of the outer palm surface attached on top of and to the entry end of the inner palm surface; a multitude of finger sheaths each having a top surface, a bottom surface, a fingertip portion, and a connection end; a thumb sheath having a top surface, the fingertip portion, and a bottom surface; a multitude of cords each with a flattened portion at one end for connecting to the finger sheath near the fingertip portion, an opposite end of each of the multitude of cords utilized for knotting to adjust the length of the cord; the back surface and the inner palm surface being attached and configured to receive a hand, each finger sheath positioned in an arc, the outer palm surface being attached to the fingertip portion of each of the arced finger sheaths which maintains the arc in the finger sheaths and restricts the finger sheaths from extending or straightening beyond the arced attachment position of the finger sheaths, an additional width of the outer palm surface extends beyond the width of the inner palm surface on both sides of the inner palm surface to close a gap between the arc of the finger sheath's bottom surface and the extended length outer palm surface, the multitude of cords, when in use tighten the arc of the finger sheaths making the finger sheath's arc smaller, which further limits the finger sheath's ability to extend or straighten, and are confined in the gap between the outer palm surface and inner palm surface, one cord for each finger sheath and being attached to the finger sheath bottom surface near the fingertip portion and extending towards and through a cord mounting tab on the inner palm surface, the multitude of cords being accessed through the outer palm surface access flap and adjustable in length once through the cord mounting tab and tied into a knot, the adjustment of each cord creating a multitude of finger sheath arc options, each arc option being smaller than the arc created from the attachment of the upper palm surface to the fingertip portion of the finger sheath, the finger sheaths retain the ability to grasp items and be fully clenched into a fist position when an internal space is occupied by a user.

14. A glove as claimed in claim 13 wherein the cords are connected to the finger sheath connection end bottom surface near the fingertip portion and also connected at a mid-point of the inner palm surface.

15. A glove as claimed in claim 13 further comprising; knuckle padding formed on the back surface of the glove including on the top surface of at least one of the finger sheaths and at least one fastening strap for securing the glove.

16. A glove comprising; a back surface; a palm surface being longer in length than the back surface; a multitude of finger sheaths each having a top surface and a fingertip portion; a thumb sheath with top and bottom surfaces; the finger sheaths placed into an arc, the fingertip portion attached to the lengthened palm surface keeping the finger sheaths in an arc position and restricting the finger sheaths from moving into a linear extended or straightened position, while allowing the finger sheaths to close through a multitude of smaller arc positions until a clenched position is achieved if desired by the user.

17. A glove as claimed in claim 16 wherein the finger sheaths have a bottom surface, the palm surface having an extended length that attaches to the fingertip portion of the finger sheaths keeping the finger sheaths in the arc position and restricting the finger sheaths from moving into the linear extended or straightened position, while allowing the finger sheaths to close through the multitude of smaller arc positions until a clenched position is achieved if desired by the user.

18. A glove as claimed in claim 16 wherein the finger sheaths have a partial bottom surface starting at the fingertip portion and being significantly shorter than the finger sheath top surface, the palm surface having an extended length which attaches to the fingertip portion of the finger sheath keeping the finger sheaths in the arc position and preventing the finger sheaths from moving into the linear extended position, while allowing the finger sheaths to close through the multitude of smaller arc positions until a clenched position is achieved if desired by the user.

19. A glove as claimed in claim 16 further comprising; knuckle padding formed on the back surface of the glove including on the top surface of at least one of the finger sheaths, and at least one fastening strap for securing the glove.

20. A glove comprising: a back surface having an entry end and a finger sheath connection end; a palm surface having an entry end, and a finger sheath connection end; a multitude of finger sheaths each having a top surface, a fingertip portion, a bottom surface, and a connection end; a thumb sheath having a top surface, a fingertip portion, and a bottom surface; a multitude of restrictive cording, one cord per finger sheath; a restrictive webbing material attached from each cord to the palm surface; the back surface and the palm surface attached and configured to receive a hand, each finger sheath positioned in an arc, one cord for each finger sheath and being attached at one cord end to the finger sheath bottom surface near the fingertip portion and extending towards and attaching on the palm surface with an opposite cord end, the cords, installed for retaining the arc of the finger sheaths and restricting the finger sheaths from extending or straightening, a webbing material attached between each cord and the palm surface keeping the cords from being hooked on objects, the finger sheaths retain the ability to grasp items and be fully clenched into a fist position when an internal space is occupied by a user.

21. A glove as claimed in claim 20 further comprising knuckle padding formed on the back surface of the glove including on the top surface of at least one of the finger sheaths, and at least one fastening strap for securing the glove.

* * * * *